US009958116B2

(12) United States Patent
Cai et al.

(10) Patent No.: US 9,958,116 B2
(45) Date of Patent: May 1, 2018

(54) GLASS JACKETED LED LAMP

(71) Applicant: Eye Lighting International of North America, Mentor, OH (US)

(72) Inventors: Dengke Cai, Willoughby, OH (US); Paul J. Jurkovic, Painesville, OH (US); Thomas G. Salpietra, Concord Township, OH (US)

(73) Assignee: Eye Lighting International of North America, Inc., Mentor, OH (US)

( * ) Notice: Subject to any disclaimer, the term of this patent is extended or adjusted under 35 U.S.C. 154(b) by 0 days. days.

(21) Appl. No.: 15/326,456

(22) PCT Filed: Mar. 21, 2016

(86) PCT No.: PCT/US2016/023494
§ 371 (c)(1),
(2) Date: Jan. 13, 2017

(87) PCT Pub. No.: WO2016/154156
PCT Pub. Date: Sep. 29, 2016

(65) Prior Publication Data

US 2017/0268730 A1 Sep. 21, 2017

Related U.S. Application Data

(60) Provisional application No. 62/136,427, filed on Mar. 20, 2015, provisional application No. 62/247,628,
(Continued)

(51) Int. Cl.
*F21V 29/00* (2015.01)
*F21K 9/275* (2016.01)
(Continued)

(52) U.S. Cl.
CPC ..... *F21K 9/275* (2016.08); *F21K 9/272* (2016.08); *F21K 9/278* (2016.08); *F21V 3/02* (2013.01);
(Continued)

(58) Field of Classification Search
CPC ..... F21K 9/275; F21K 9/278; F21K 9/272; F21V 29/83; F21V 3/0418; F21V 3/02; F21V 31/00; F21V 5/02; F21Y 2115/10
See application file for complete search history.

(56) References Cited

U.S. PATENT DOCUMENTS 5,726,535 A 3/1998 Yan
8,587,186 B2 11/2013 Hoetzl et al.
(Continued)

FOREIGN PATENT DOCUMENTS

EP 2937624 A1 10/2015
WO WO2013007814 A2 1/2013
WO WO2013007815 A1 1/2013

*Primary Examiner* — Y M Lee
(74) *Attorney, Agent, or Firm* — Dwight A. Stauffer, Patent Agent

(57) ABSTRACT

A glass jacketed led lamp is characterized by a prismatic LED module positioned coaxial to the axis of a cylindrical glass jacket having an inside diameter D1, wherein the LED module comprises: a prismatic LED carrier structure having N longitudinal sides, and LEDs that are operationally mounted on at least one of the N sides; wherein: the carrier structure was formed by folding a single metal core printed circuit board (MCPCB) into a convex prismatic polyhedron; the prism cross section is an irregular and incomplete polygon such that the N sides are bounded by N+1 longitudinal fold edges, wherein a first edge and the (N+1)th edge are back edges that are spaced apart by a first separation GAP1.

18 Claims, 20 Drawing Sheets

Related U.S. Application Data filed on Oct. 28, 2015, provisional application No. 62/308,170, filed on Mar. 14, 2016.

(51) Int. Cl.

| | |
|---|---|
| ***F21V 5/02*** | (2006.01) |
| ***F21K 9/278*** | (2016.01) |
| ***F21V 31/00*** | (2006.01) |
| ***F21K 9/272*** | (2016.01) |
| ***F21V 3/02*** | (2006.01) |
| ***F21V 3/04*** | (2018.01) |
| ***F21V 29/83*** | (2015.01) |
| *F21Y 115/10* | (2016.01) |

(52) U.S. Cl.

CPC ..... *F21V 3/0418* (2013.01); *F21V 5/02* (2013.01); *F21V 29/83* (2015.01); *F21V 31/00* (2013.01); *F21Y 2115/10* (2016.08)

(56) References Cited

U.S. PATENT DOCUMENTS

| | | | | |
|---|---|---|---|---|
| 8,591,062 | B2 | 11/2013 | Hussell et al. | |
| 8,757,839 | B2 | 6/2014 | Hussell et al. | |
| 2004/0114367 | A1* | 6/2004 | Li | F21K 9/232 362/248 |
| 2006/0203482 | A1 | 9/2006 | Allen et al. | |
| 2009/0236992 | A1 | 9/2009 | Chiang | |
| 2012/0195053 | A1 | 8/2012 | Wu | |
| 2014/0340896 | A1* | 11/2014 | Verbeek | F21V 7/0008 362/235 |
| 2015/0285472 | A1* | 10/2015 | Evitt | F21V 17/007 362/224 |
| 2015/0292726 | A1* | 10/2015 | Den Boer | F21K 9/90 313/46 |
| 2016/0341370 | A1* | 11/2016 | Dekker | F21V 29/004 |

* cited by examiner

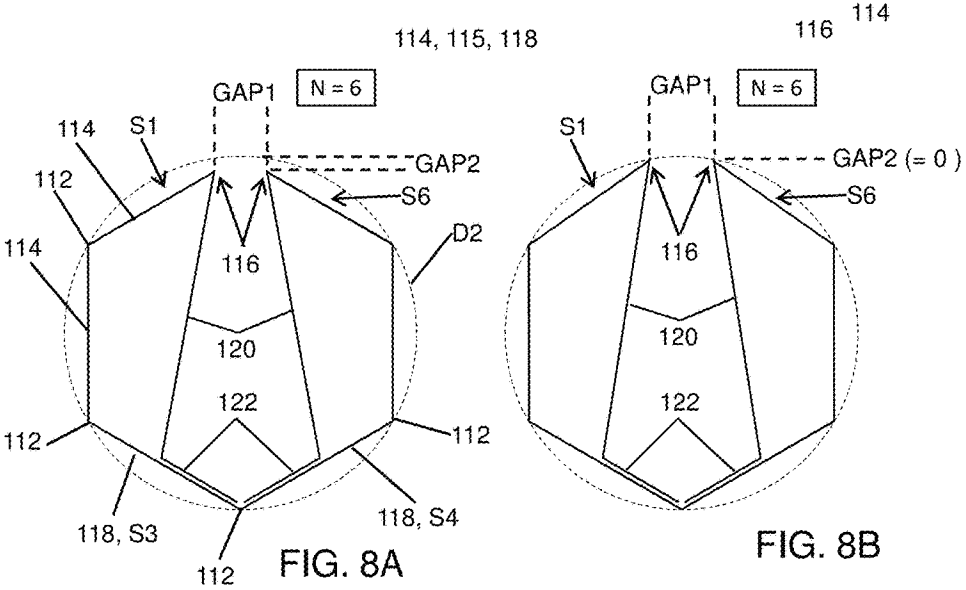
FIG. 8A
FIG. 8B
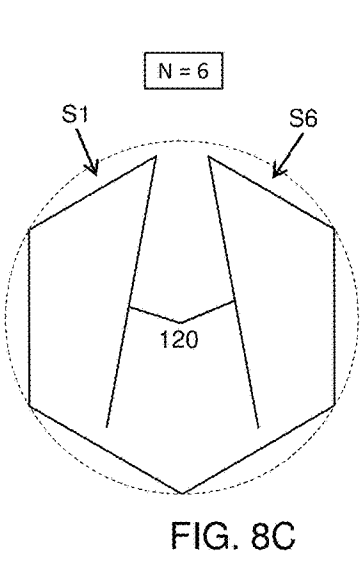
FIG. 8C
FIG. 8D
FIG. 8E
FIG. 8F
FIG. 8G

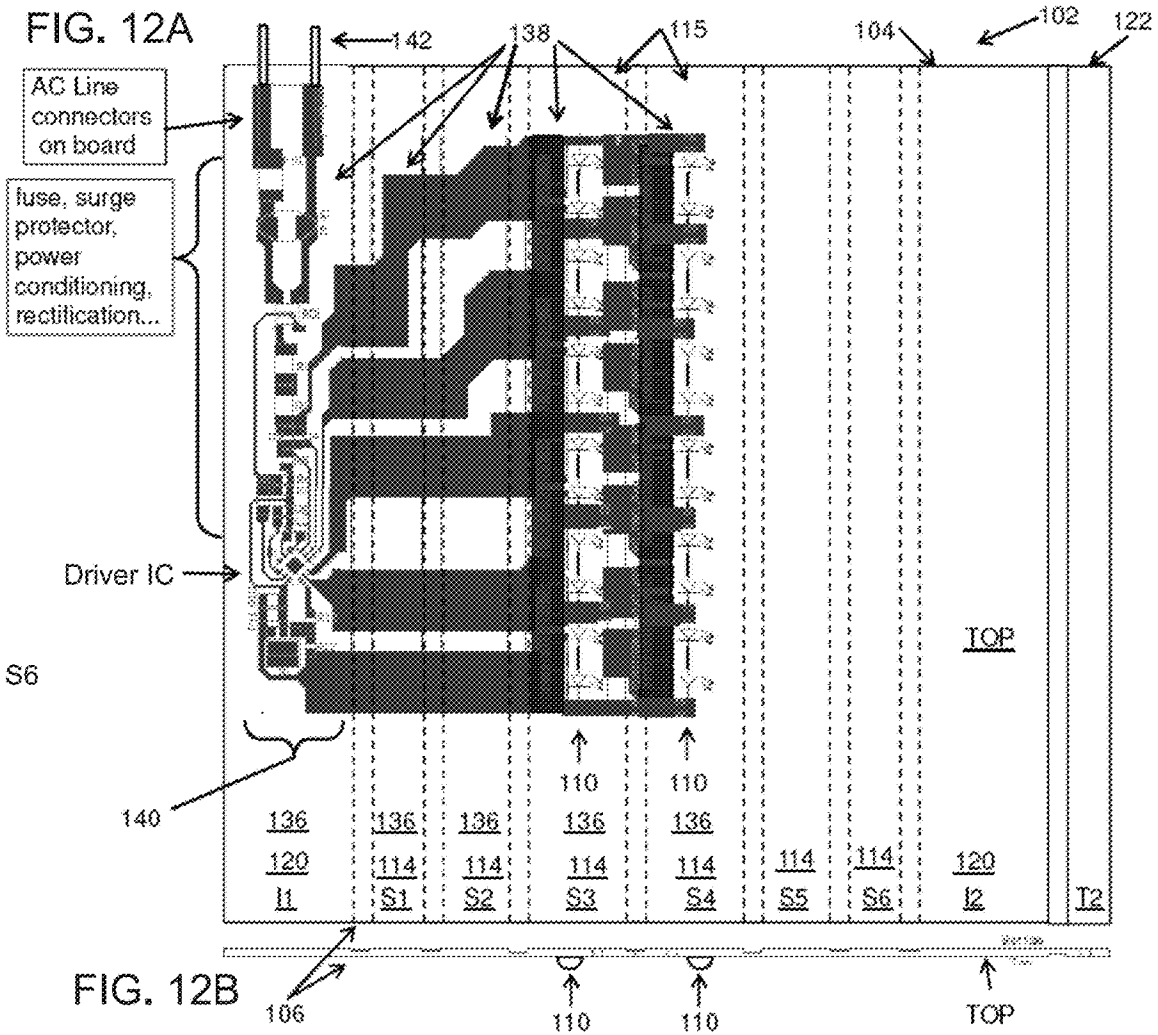
FIG. 12A
FIG. 12B
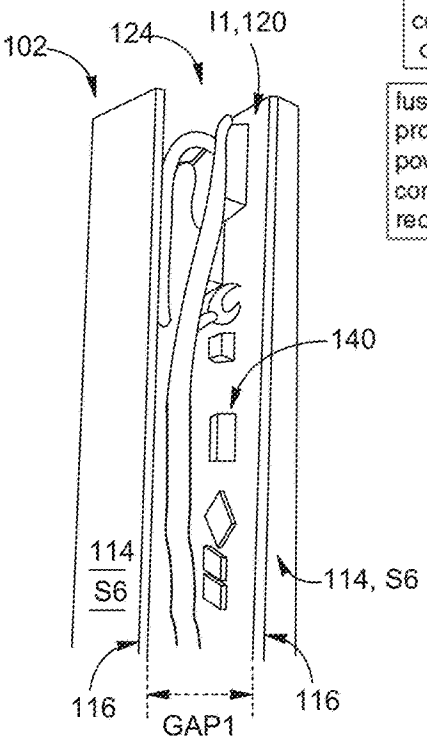
FIG. 12C

GLASS JACKETED LED LAMP

CROSS-REFERENCE TO RELATED APPLICATIONS

This application claims the benefit of U.S. Provisional Patent Application No. 62/136,427 filed Mar. 20, 2015; U.S. Provisional Patent Application No. 62/247,628 filed Oct. 28, 2015, and U.S. Provisional Patent Application No. 62/308,170 filed Mar. 14, 2016, said applications hereby incorporated in their entirety by reference herein.

BACKGROUND OF THE INVENTION

It is desirable to provide an LED lighting source with an overall shape and/or size within the bounds of a lamp with equivalent light output (e.g., lumens) that it replaces. This is particularly difficult for higher output lamps, such as HID lamps (e.g., HPS, MH, CMH), due to the need for cooling of the LED junction. A prior art solution has been to mount LED modules on an open framework extended from the lamp base such that ambient air can circulate through cooling fins on the back of the module(s). However, this may have problems if exposed to wet, dirty, or otherwise unfavorable ambient conditions. In other cases, an enclosure may be needed to prevent physical contact. Thus enclosing the LEDs in a glass bulb/enclosure/jacket is desired, but attempts so far are generally limited to a low power due to difficulty of extracting heat from the enclosed volume, or for higher power the lamp assembly is overly complicated and expensive.

It is an object of this disclosure to replace an HID lamp with an enclosed LED light source of equivalent (high) lumen output. It may be further desirable for the LED source to be contained in a bulb (outer jacket) with an electrical connector configuration that can be retrofit into an existing fixture. This means that relatively high power LEDs must be used, and that will require new means and methods for adequately cooling the LEDs.

BRIEF SUMMARY OF THE INVENTION

According to the invention a glass jacketed led lamp is characterized by a prismatic LED module positioned coaxial to the axis of a cylindrical glass jacket having an inside diameter D1, wherein the LED module comprises: a prismatic LED carrier structure having N longitudinal sides, and LEDs that are operationally mounted on at least one of the N sides; wherein: the carrier structure was forming by folding a single metal core printed circuit board (MCPCB) into a convex prismatic polyhedron; the prism cross section is an irregular and incomplete polygon such that the N sides are bounded by N+1 longitudinal fold edges, wherein a first edge and the (N+1)th edge are back edges that are spaced apart by a first separation GAP1; and the MCPCB board extends from at least one of the back edges inward toward a distal front side, thereby forming at least one interior wall that divides the structure into an open cavity flanked by at least one side cavity; and at least the second through the Nth edges are in thermal contact with the glass jacket. Preferably the back edges are also spaced inward from the jacket inside diameter D1 by a second separation GAP2.

According to the invention the at least one interior wall is thermally attached to a distal front side, thereby additionally heat sinking the front side.

According to the invention LEDs mounted only on one or two front sides; thereby providing directed light output with a beam spread substantially determined by the angles at the edges of the one or two front sides.

According to the invention, in an unbiased neutral state, the LED carrier edges are circumscribed by a circle of diameter D2' that is greater than the jacket inside diameter D1, and the metal board is resilient with a spring bias toward the neutral state, such that the module is in a constricted state when inside the jacket, thereby biasing the fold edges into thermal contact with the jacket wall, and providing friction to hold the LED module in a predetermined longitudinal position within the jacket.

According to the invention, a wool-like porous and highly interconnected lightweight material having thermal conductivity greater than about 10 W/mK, substantially filling one or more of the center and side cavities, and thermally contacting the MCPCB walls therearound.

According to the invention, the LED carrier is a metal printed circuit board (MCPCB) comprising: a polyimide dielectric layer, and copper traces without a solder mask layer; thereby enabling MCPCB bending without surface cracking, and minimizing potential VOC emissions.

According to the invention, an AC LED driver circuit mounted on at least one carrier side that is separate from any side that is an LED mounting face According to the invention, AC LED driver circuit mounted on at least one of the at least one interior walls.

According to the invention, a lamp base adhered over an open end of the jacket.

According to the invention, the base is plastic.

According to the invention, the base has thermal conductivity greater than 1 W/mK.

According to the invention, the LED carrier extends into thermal contact with the base.

According to the invention, the base comprises a watertight seal for the lamp wherein vent openings are sealed or covered by a methyl silicone breathable membrane or adhesive or sealant, thereby allowing egress of volatile materials while blocking liquid water.

According to the invention, a desiccant material inside the jacket.

According to the invention, one or a combination of getters for capturing volatile materials, wherein the getters are selected from a group that includes: active carbon, natural zeolite, de-aluminized zeolite, surface treated zeolite, and silica.

According to the invention, the base is at least partly made from a porous ceramic having a pores too small to allow passage of liquid water.

According to the invention, the porous ceramic is etched polycrystalline alumina.

The present disclosure includes the following material:

- heat extraction from LED PCB in a glass jacket (GJ), including a folded PCB support structure/heat sink.
  - Further development of folded PCB support structure/heat sink, and cylindrical T-bulb for glass outer jacket (GJ, or OJ)
- getters in GJ LED lamps (zeolite, moisture adsorbers)
- metal wool heat conductive filling
- unsealed (air filled) OJ (outer jacket) with breathable plug to vent outgassed VM (volatile materials), and humidity adsorber.
- LED driver "on board" (on the MCPCB Metal Core Printed Circuit Board) of the LED carrier
  - driver on board is mounted on MCPCB walls inside the folded structure (in cavity)
- plastic base/cap glued on instead of heat sealed glass (preferably clamped in fixture, not screw base) and vent hole is covered by a sticker/patch version of the silicone membrane no jacket, put in a sealed fixture with lens for protection, attach a mounting bracket to MCPCB that conducts heat away to fixture frame/structure (e.g., Urban Act floodlight fixture that uses 50 w or 75 W CMH lamps, 4-6" long, Horizontal in reflector. LEDs on two sides yields 270 degree beam spread without using reflector.)

refinements, more details and/or improvements plastic cap on both ends, so that plain cylindrical tube can be used without needing domed end LEDs can be applied to any or all outside surfaces of the folded MCPCB yielding directional or non-directional lighting, LEDioc with a blank side, etc.

use this to replace HID lamps & ballasts by retrofitting in old fixtures (e.g., "shoebox").

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 109, 109', and 109" are three different versions of an element 109 which are similar or related in some way but are separately referenced for the purpose of describing modifications to the parent element (109). Such relationships, if any, between similar elements in the same or different figures will become apparent throughout the specification, including, if applicable, in the claims and abstract.

Figures 1A, 1B:
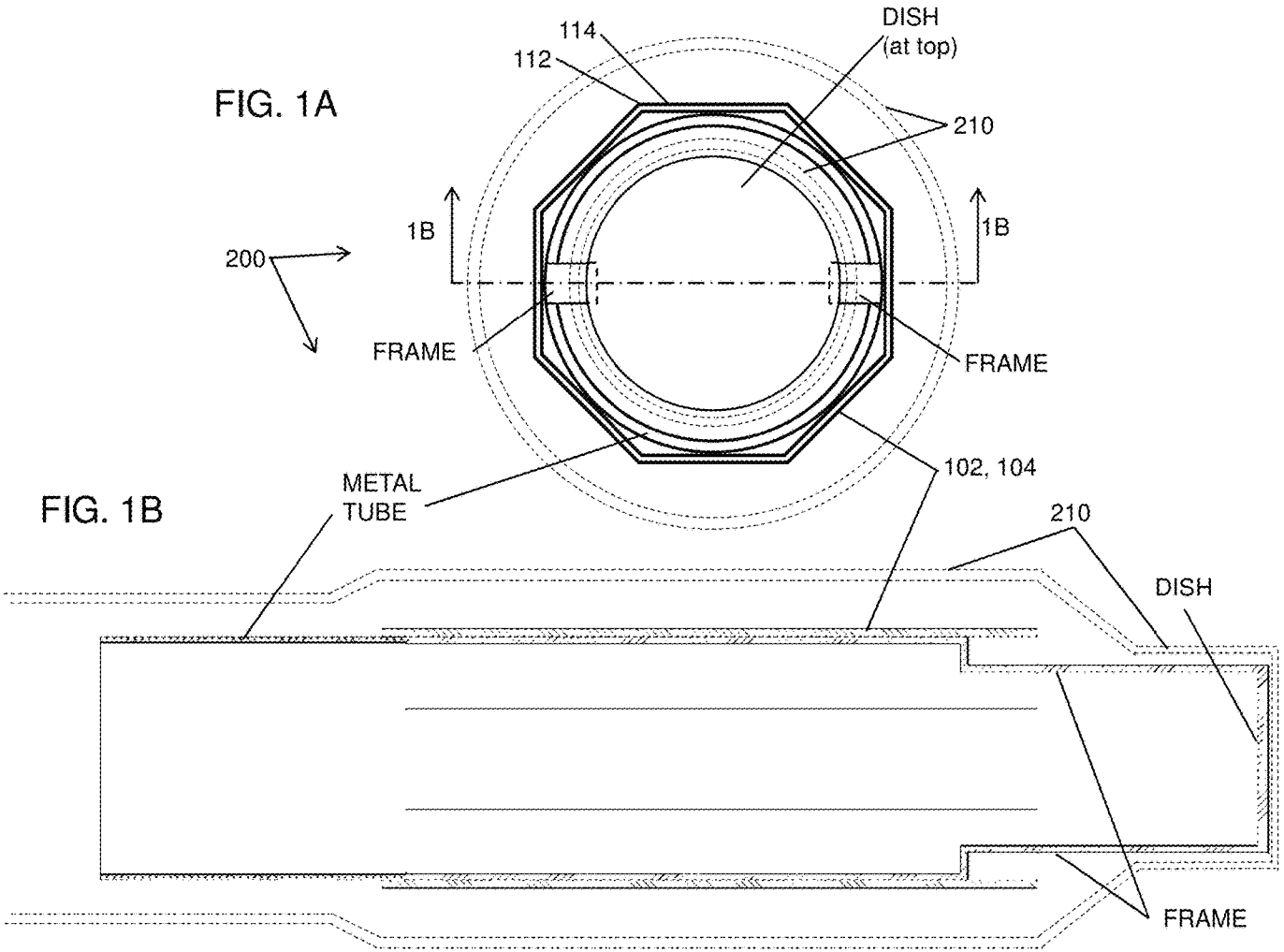

The structure, operation, and advantages of the present preferred embodiment of the invention will become further apparent upon consideration of the following description taken in conjunction with the accompanying drawings, wherein:

FIGS. 1A and 1B are a top view, and a side cross-sectional view taken along a line 1B-1B, respectively, of a glass jacketed LED lamp according to an embodiment of the invention.

Figures 2A, 2B:
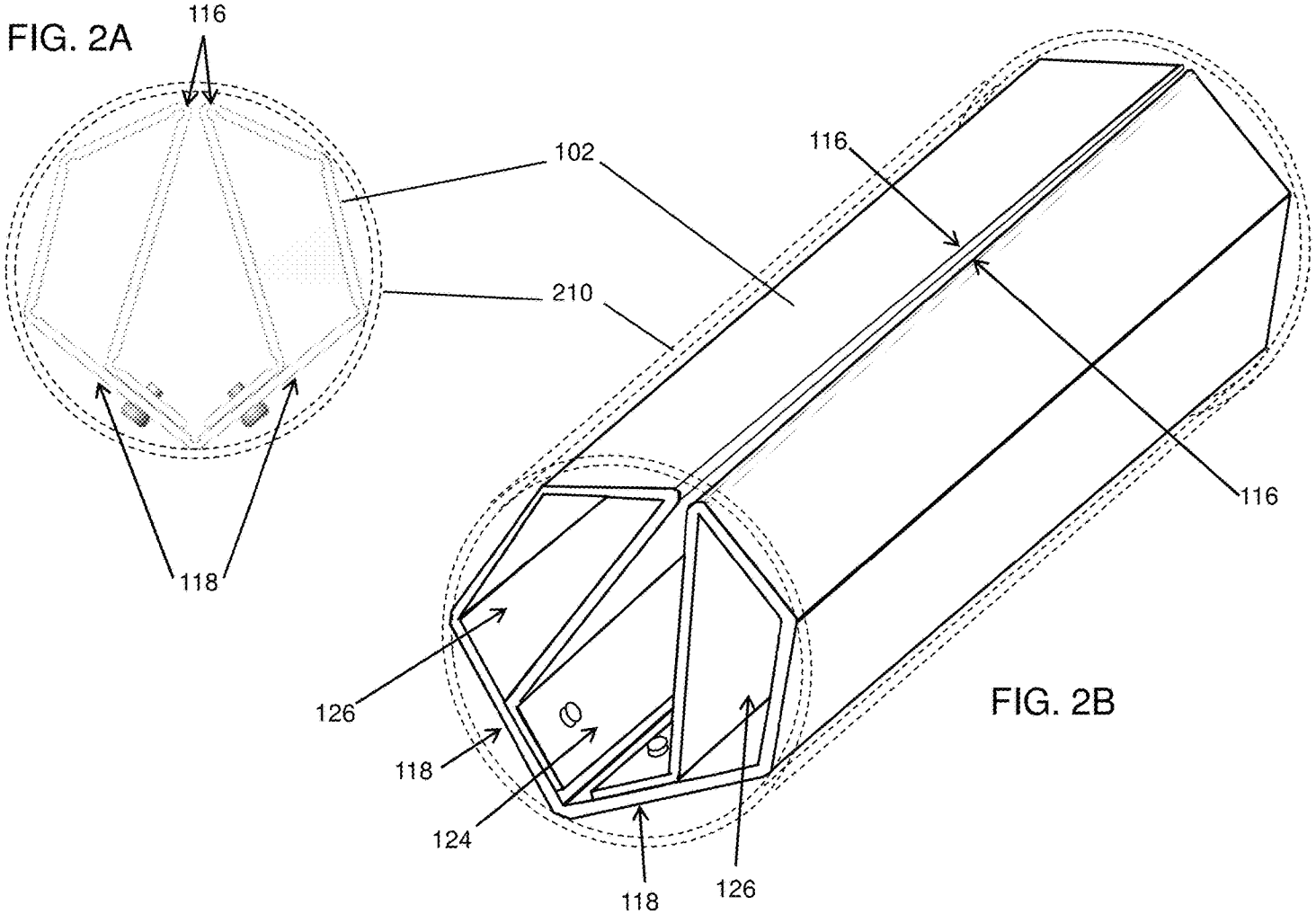

FIGS. 2A and 2B are an end cross-sectional view and a perspective view, respectively, of parts of a glass jacketed LED lamp, according to an embodiment of the invention.

Figure 3:
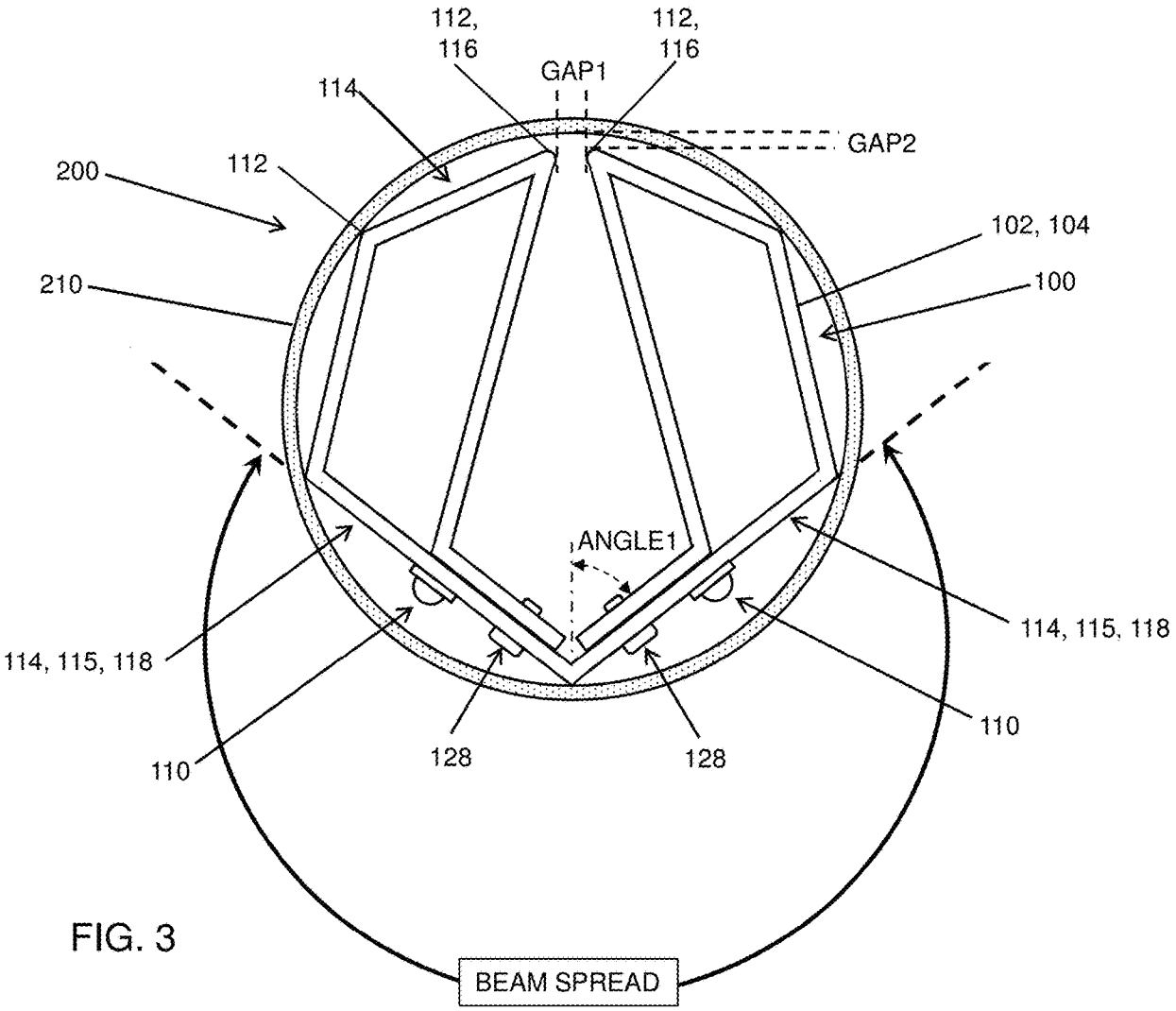

FIG. 3 is an end cross-sectional view of a glass jacketed LED lamp according to an embodiment of the invention.

Figure 4:
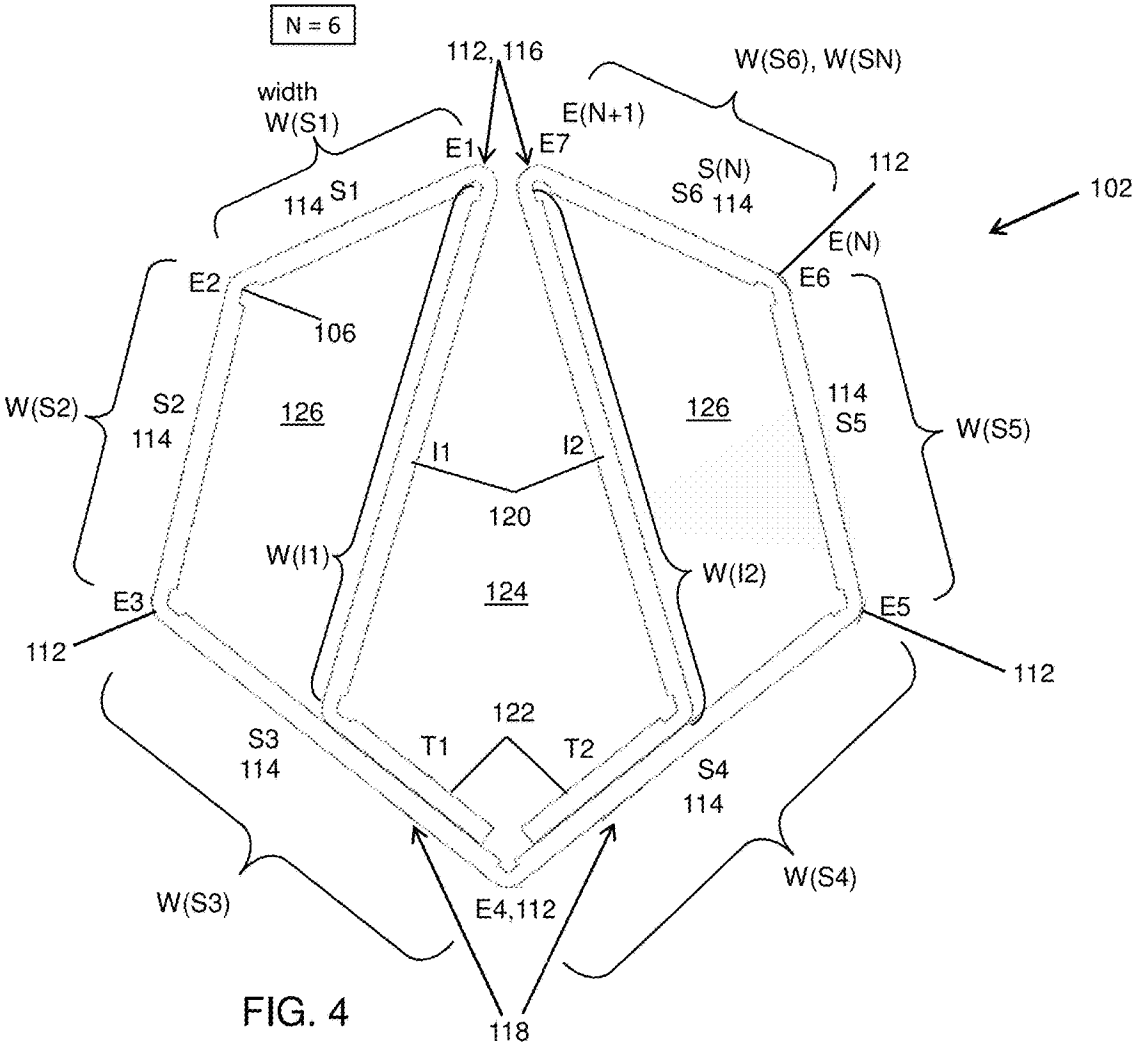

FIG. 4 is an end view of an LED carrier structure according to an embodiment of the invention.

Figures 5A, 5B:
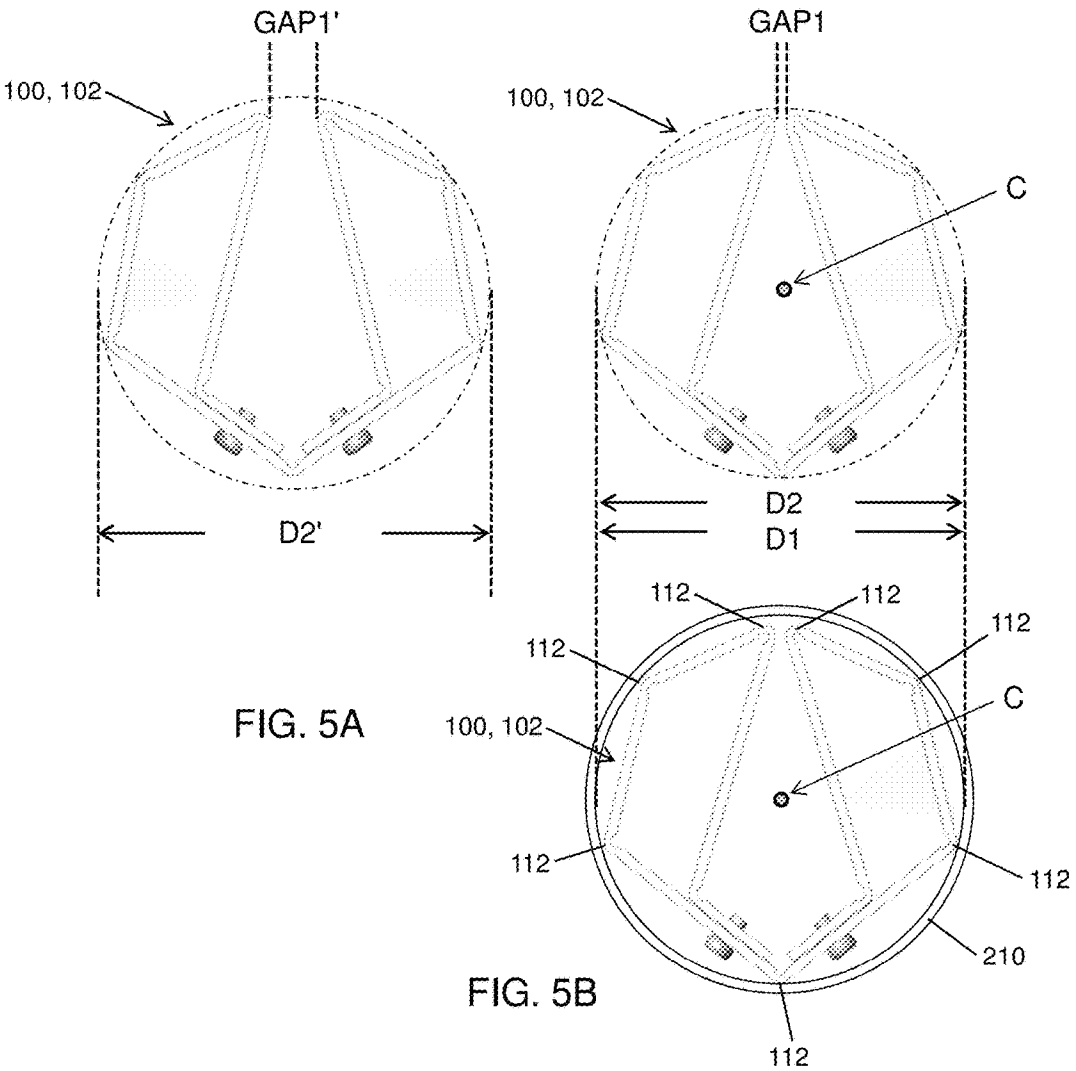

FIG. 5A is an end view of an LED carrier structure showing dimensions for a pre-formed prismatic shape, according to an embodiment of the invention.

FIG. 5B is an end view of the LED carrier structure of FIG. 5A showing dimensions relative to a glass jacket for a shape after constriction to slide into the glass jacket, according to an embodiment of the invention.

Figures 6A, 6B:
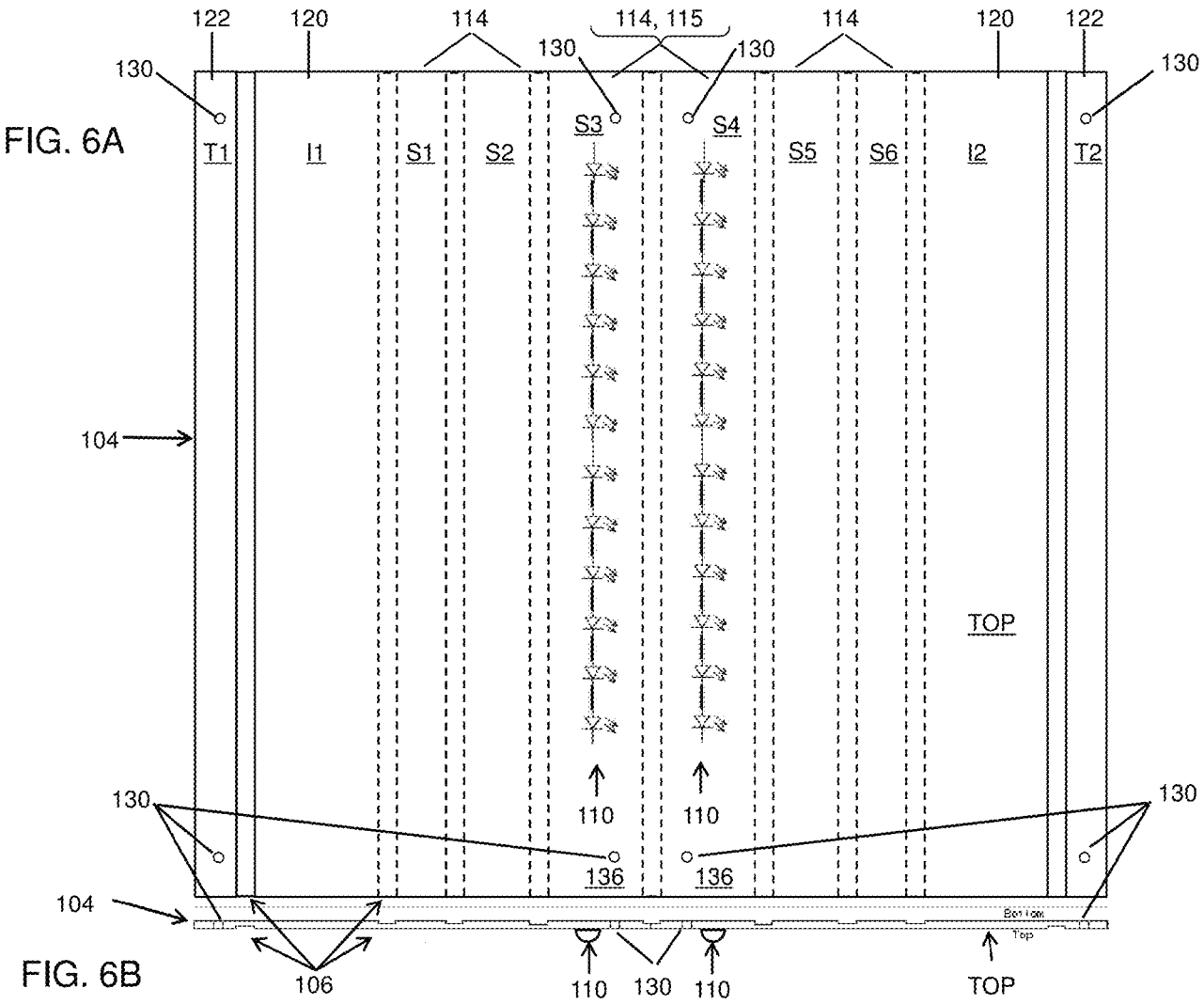

FIGS. 6A and 6B are a plan view and an end view, respectively, of a metal core printed circuit board (MCPCB) according to an embodiment of the invention.

Figure 7:
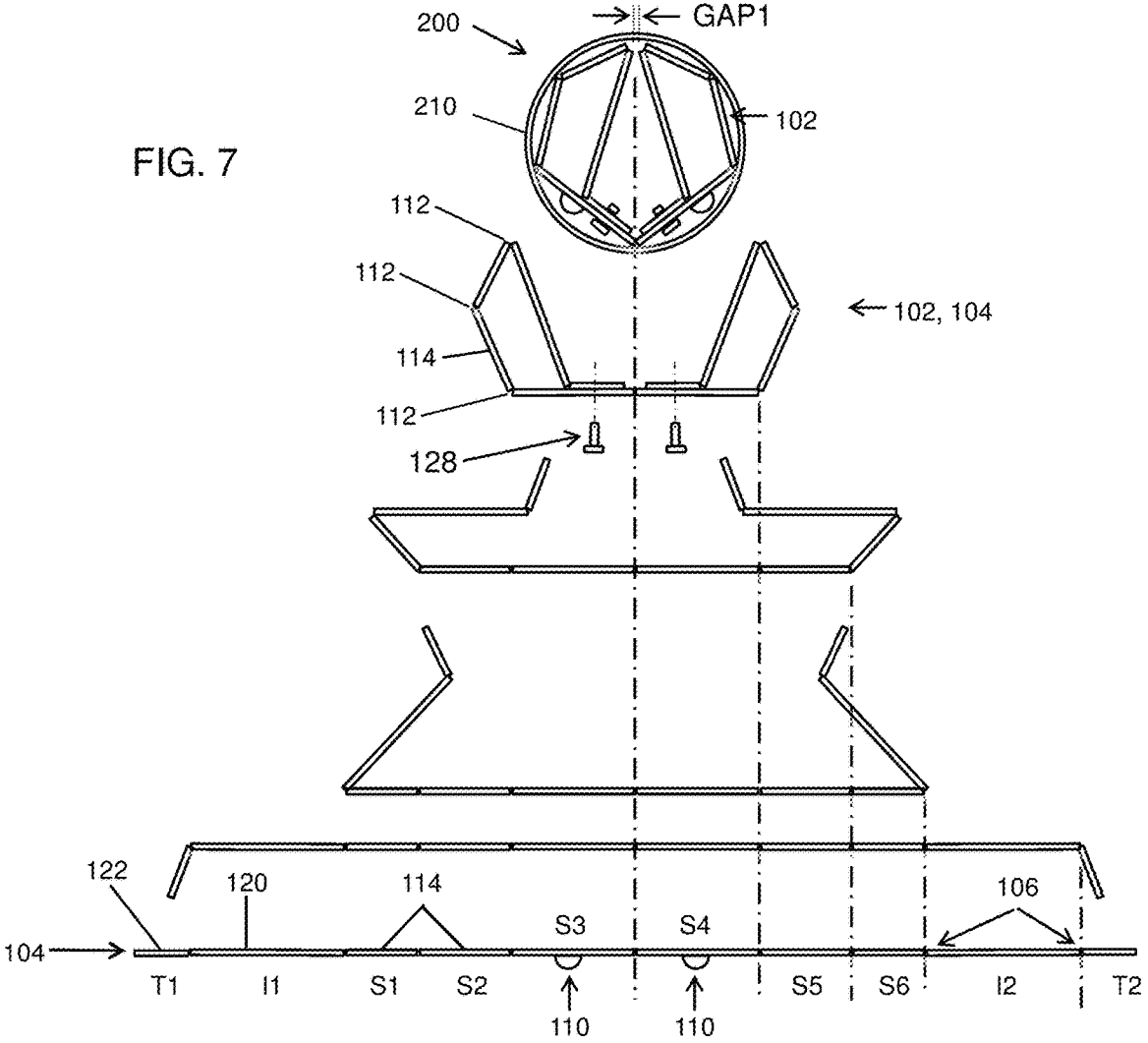

FIG. 7 is a schematic end view of steps in folding and assembling an MCPCB into a prismatic LED carrier structure that is inserted in a glass jacket to form an LED lamp according to an embodiment of the invention.

FIGS. 8A-8G schematically show example embodiments of the MCPCB folded to form an LED carrier structure according to various embodiments of the invention.

Figures 9A, 9B:
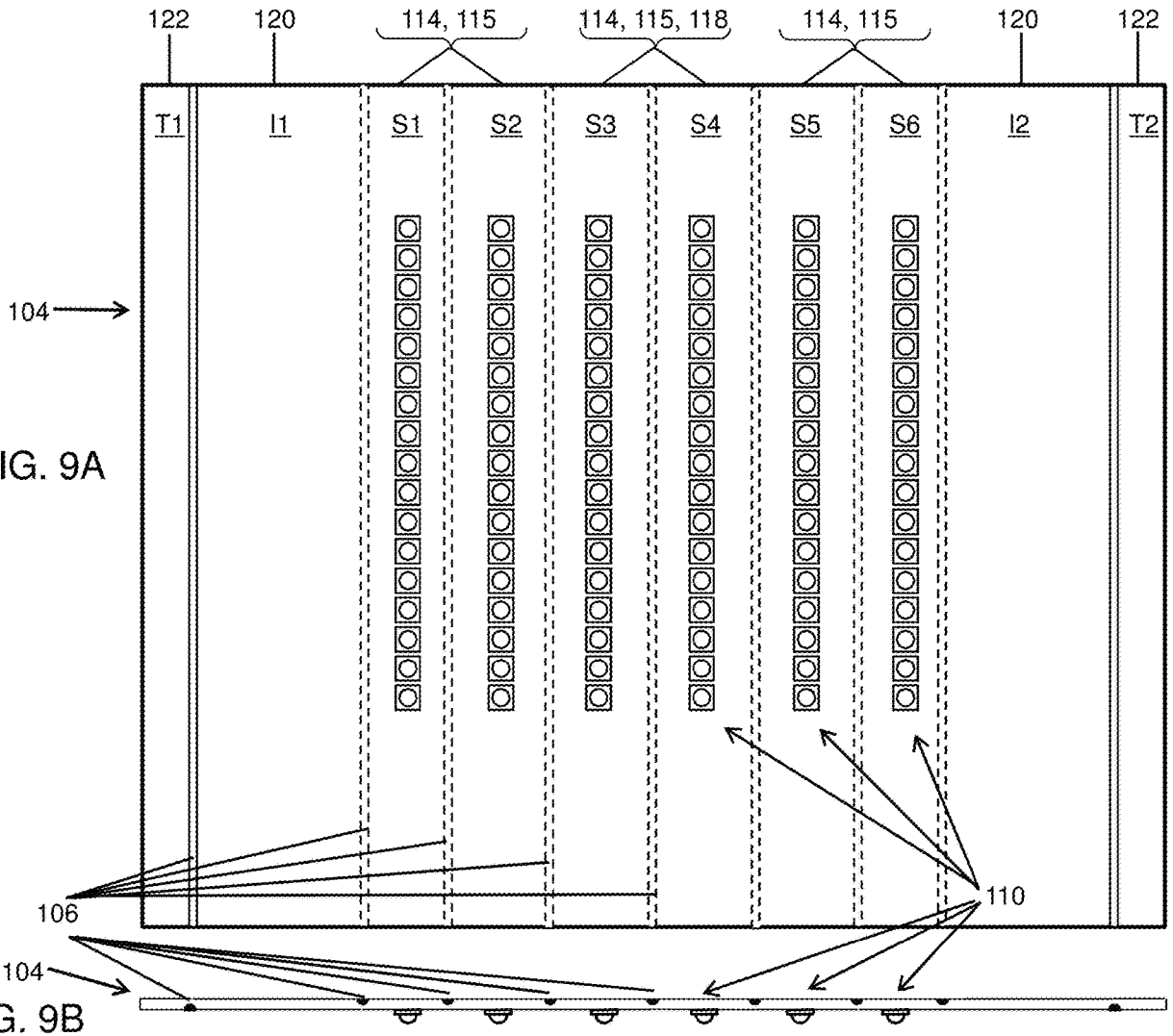

FIGS. 9A and 9B are a plan view and an end view, respectively, of a metal core printed circuit board (MCPCB) with LEDs, according to an embodiment of the invention.

Figure 10:
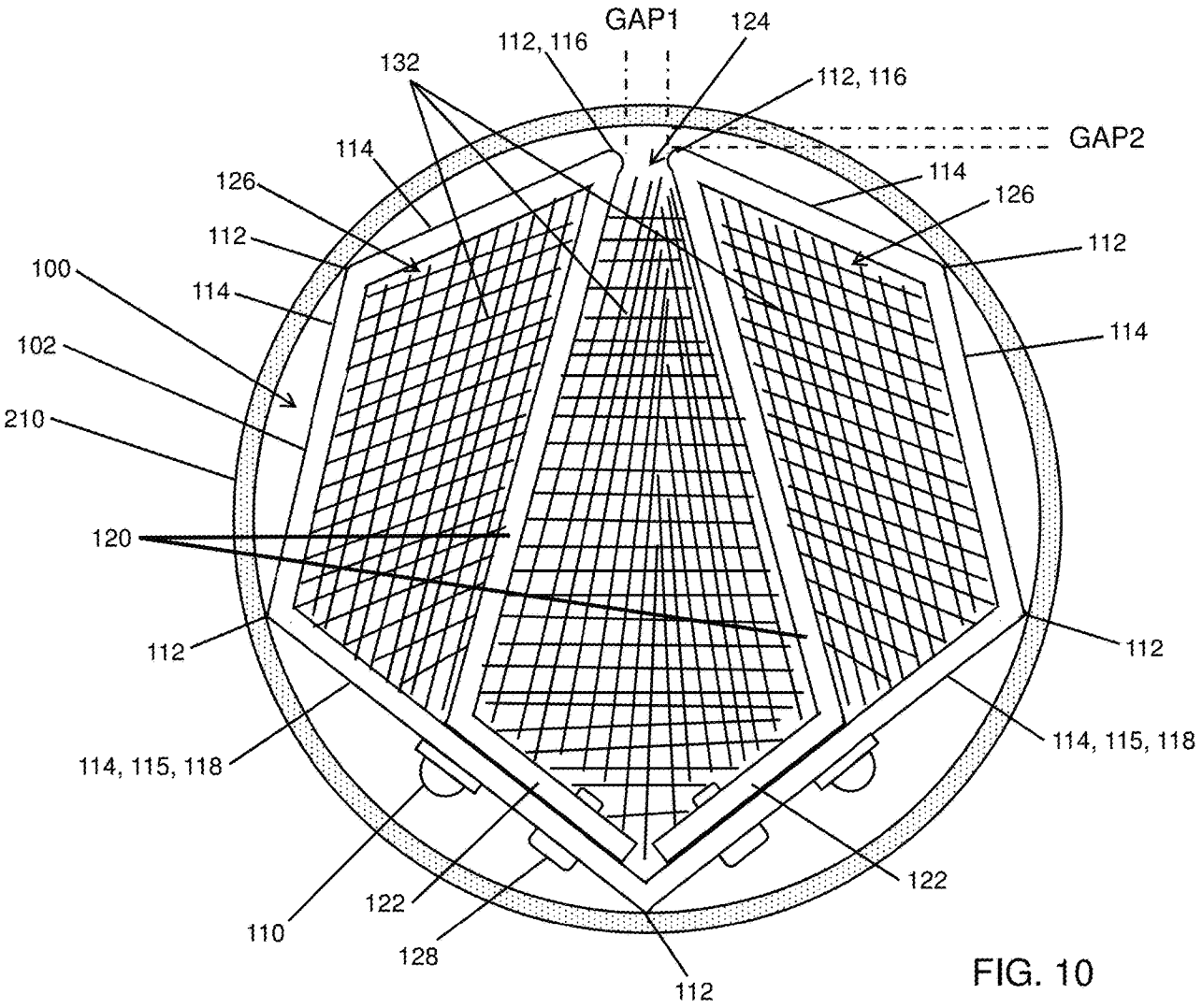

FIG. 10 is an end view of the LED carrier structure inside a tubular jacket, showing a thermally conductive light weight material used to fill cavities inside of the structure according to an embodiment of the invention.

Figure 11:
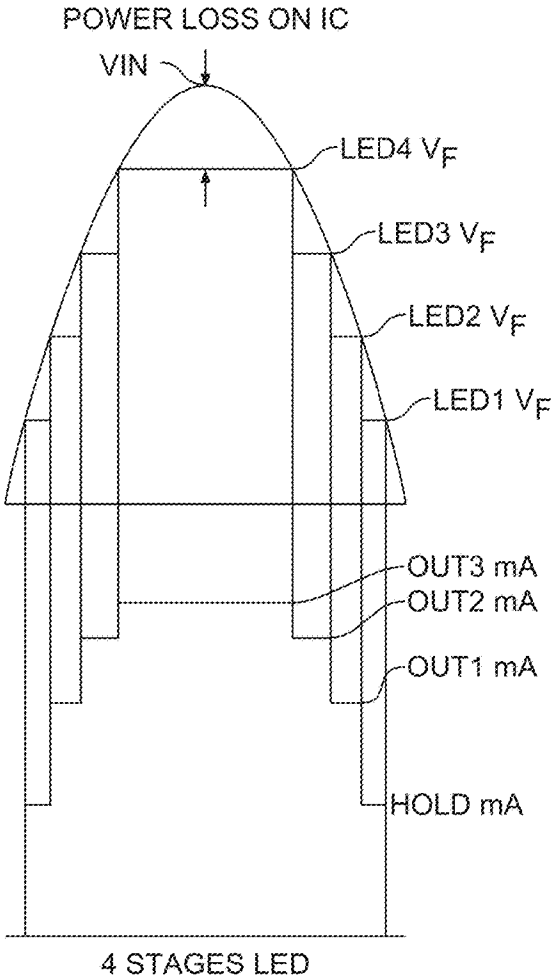
Figure 11:
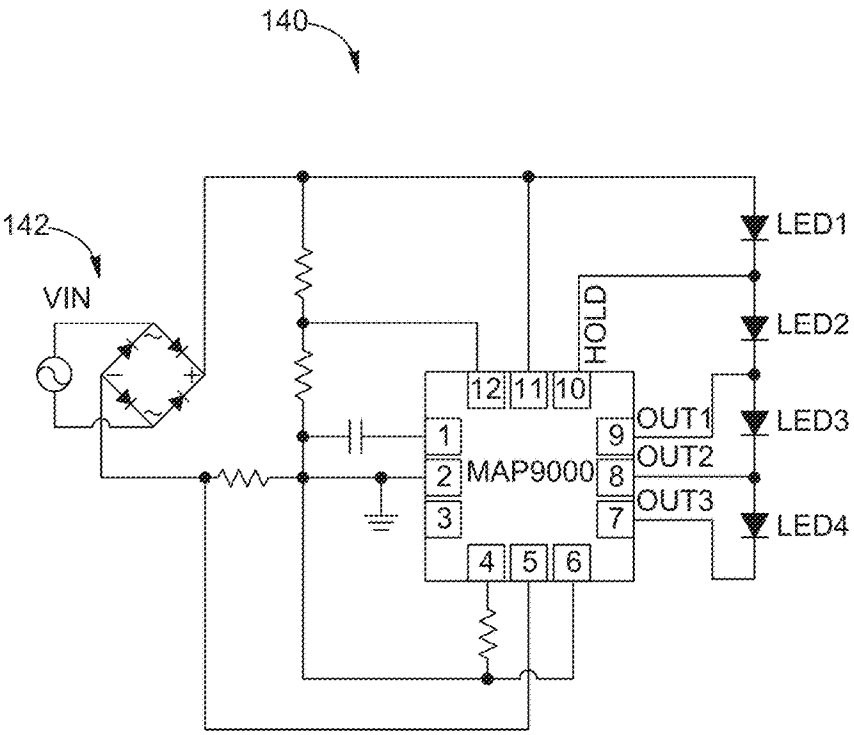

FIG. 11 is a schematic view of an LED driver circuit, and a plot of its electrical output, according to an embodiment of the invention.

FIGS. 12A and 12B are a plan view and an end view, respectively of a metal core printed circuit board (MCPCB) according to an embodiment of the invention.

FIG. 12C is a perspective view of a portion of the MCPCB of FIGS. 12A-12B after folding to the prismatic shape of the LED carrier, according to an embodiment of the invention.

Figures 13A, 13B:
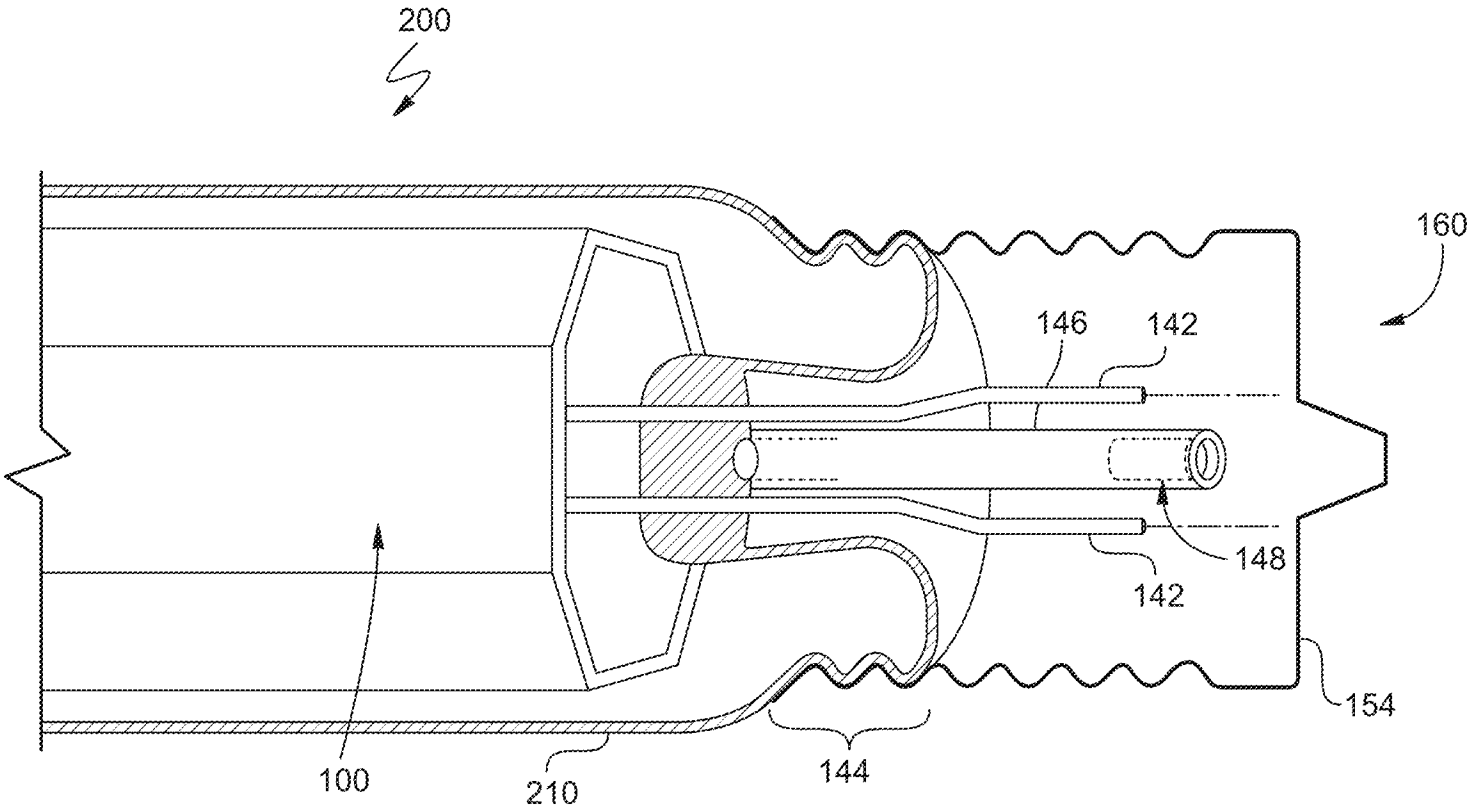

FIGS. 13A and 13B are a side view of a non-hermetically sealed LED lamp with a water blocking plug in an un-tipped exhaust tube covered by a lamp base, according to an embodiment of the invention.

FIGS. 14A-14D illustrate non-hermetically sealed LED lamps in an open ended tubular outer jacket with an adhered cap base, wherein 14A is a side view of a single ended lamp, 14B is a partial side cross-section view taken along the line 14B-14B, 14C is an end cross-section view taken along the line 14C-14C, and 14D is a side view of a double ended lamp, all according to embodiments of the invention.

Figure 15B:
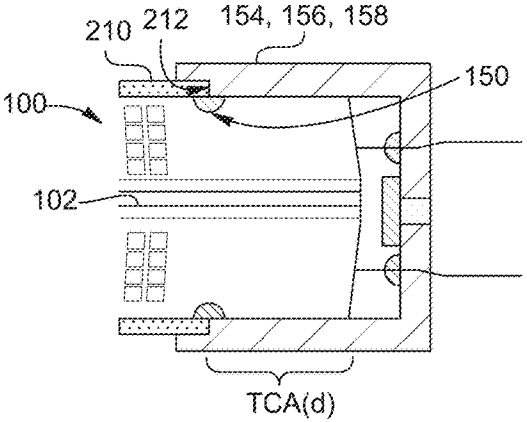
Figure 15A:
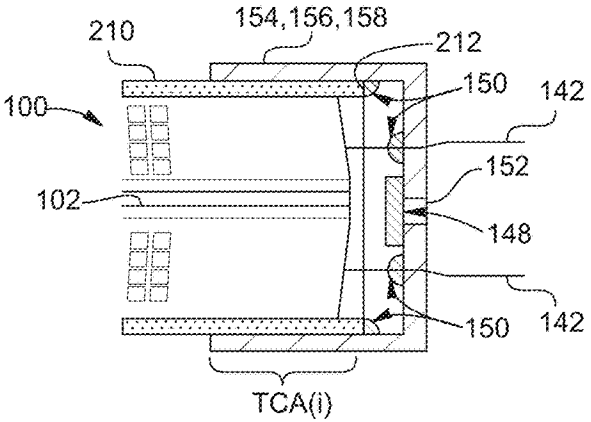
Figure 15C:
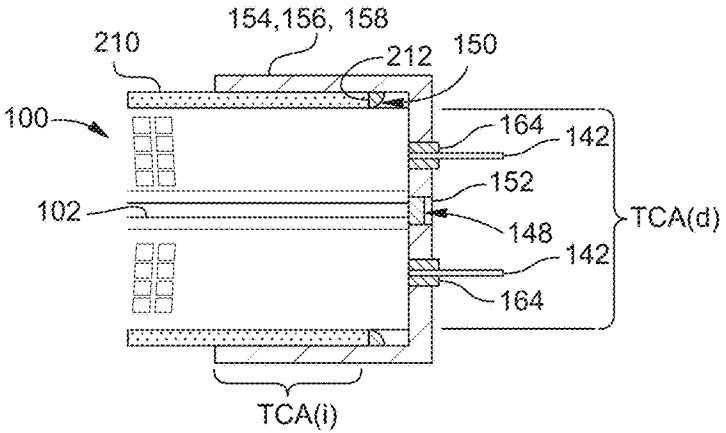

FIGS. 15A-15C are side cross-section views of a base end portion of various open ended tubular outer jackets with adhered cap bases, all according to embodiments of the invention.

Figure 16:
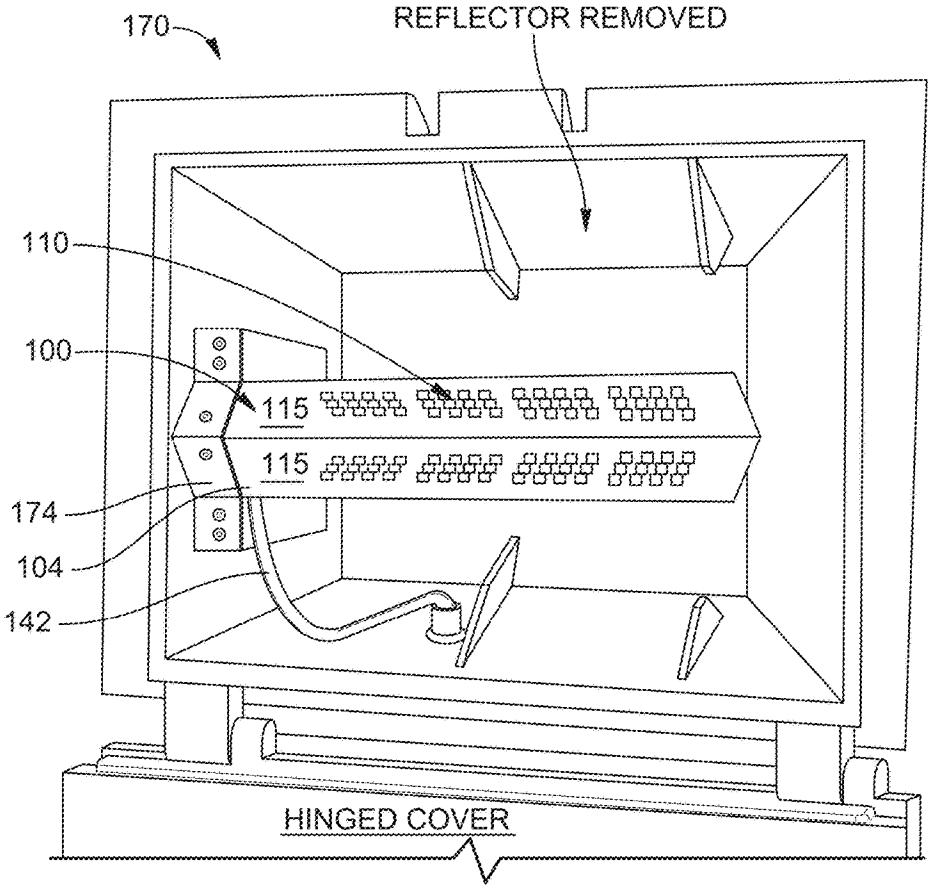

FIG. 16 is a top view of an LED module clamped in a modified HID fixture housing, according to an embodiment of the invention.

Figure 17:
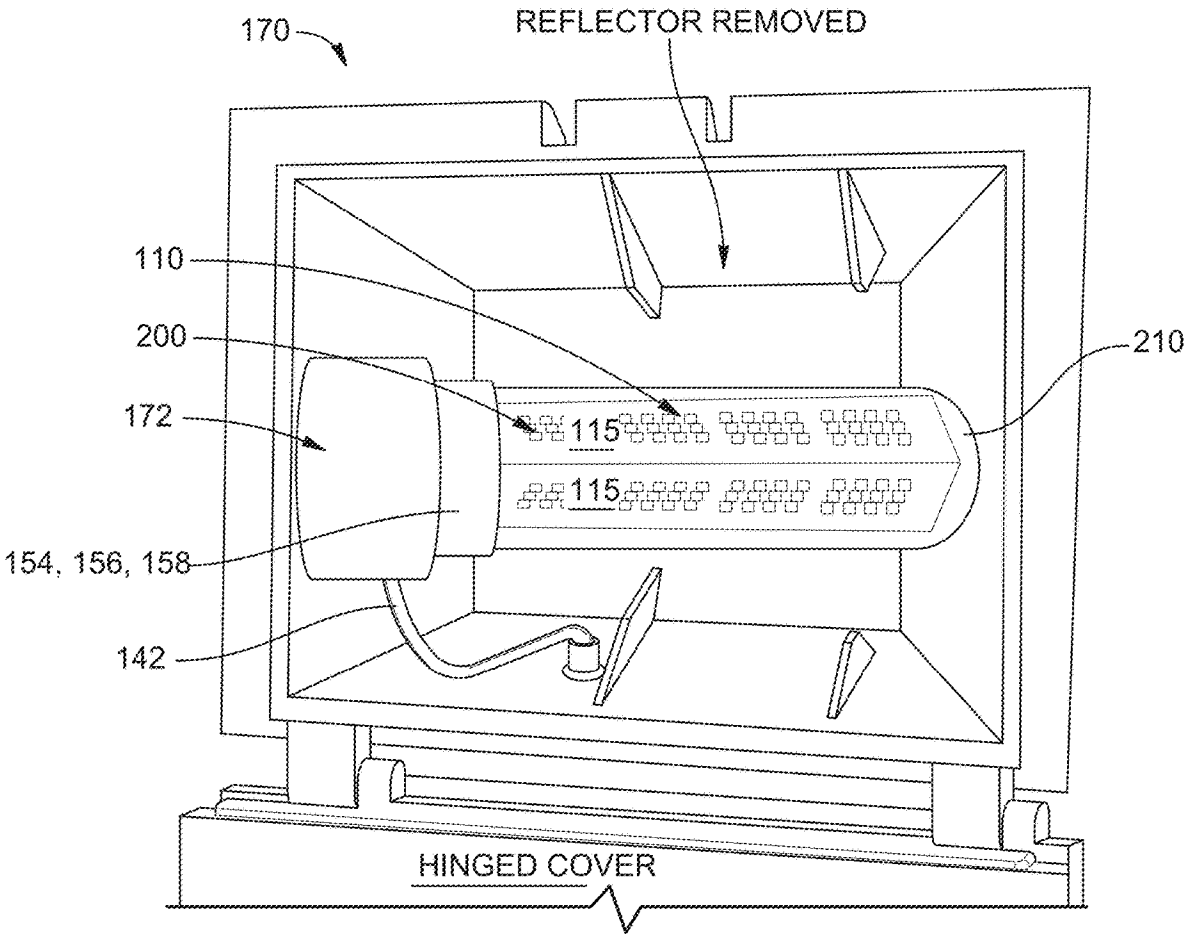
Figure 18:
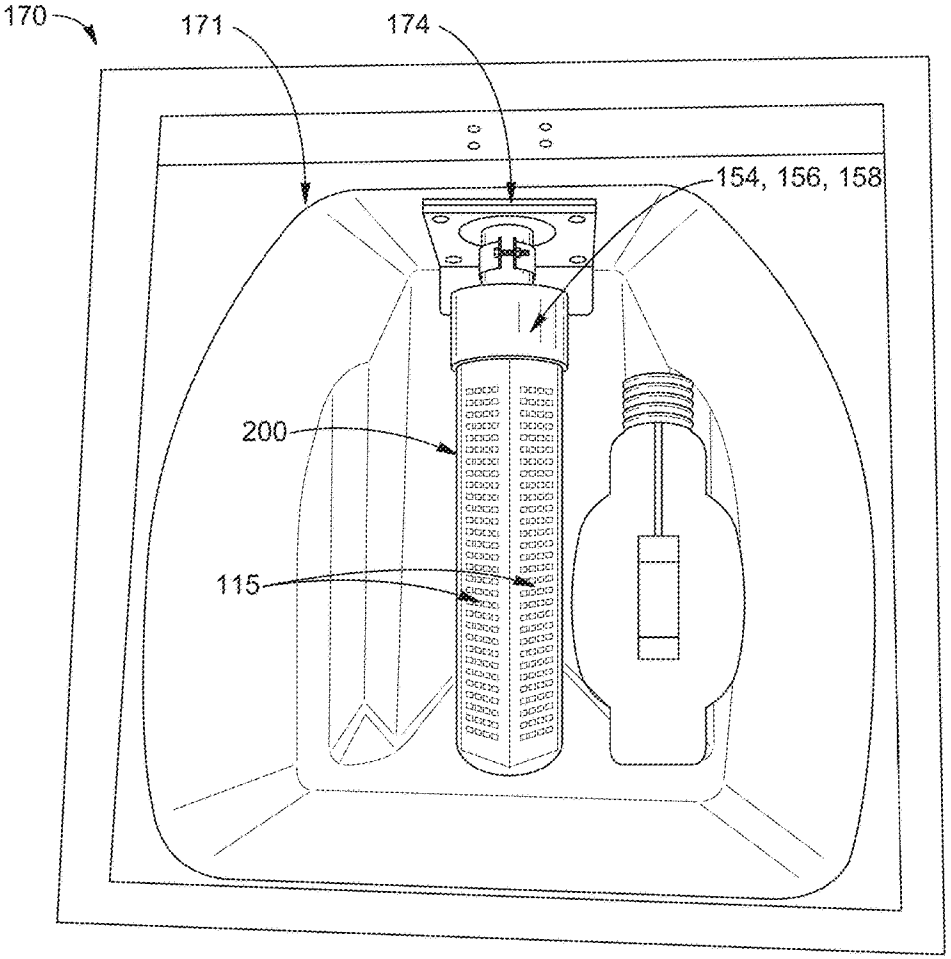

FIGS. 17 and 18 are top views of LED lamps installed in modified HID fixture housings according to embodiments of the invention.

Figure 19:
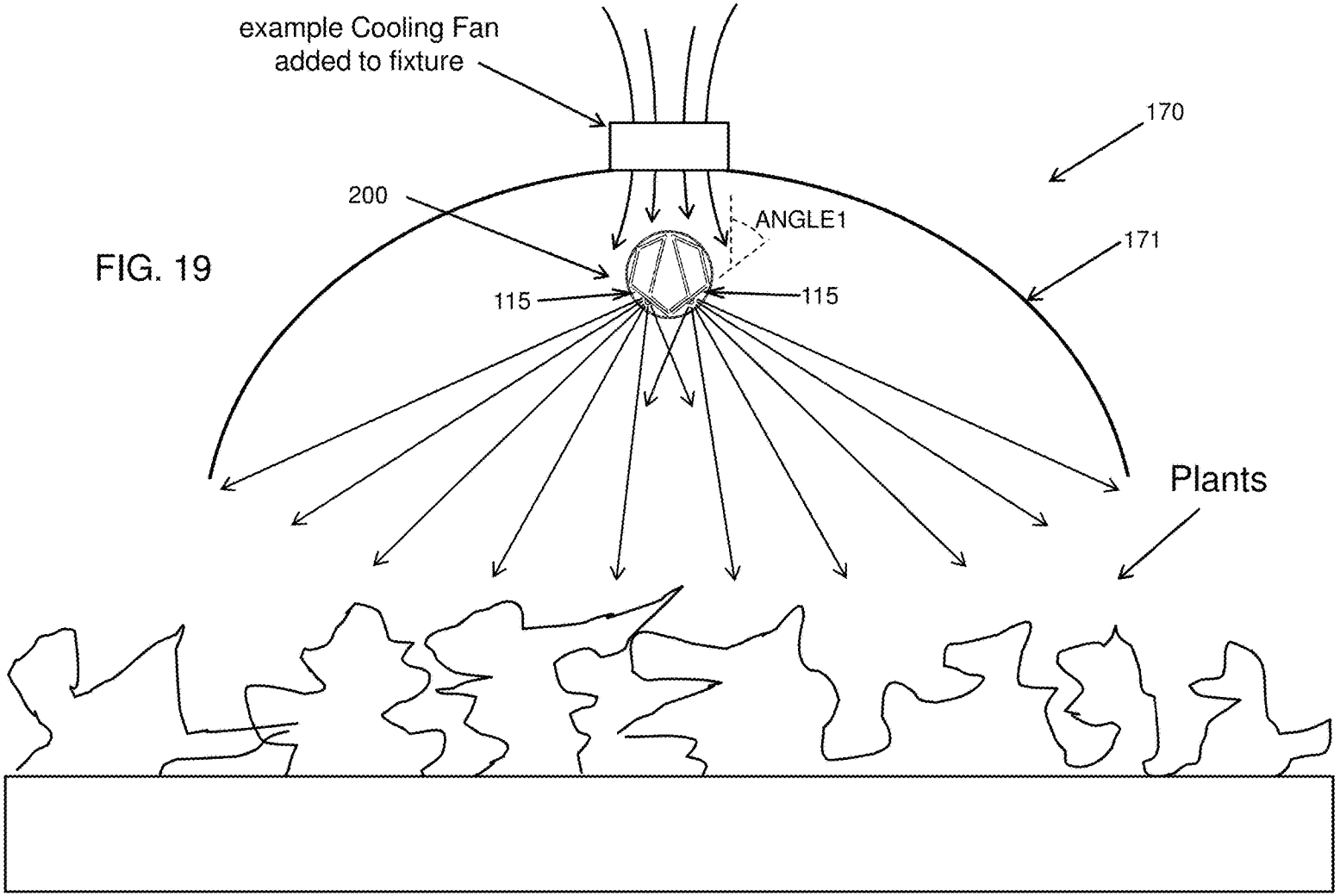

FIG. 19 is a schematic end view of a horizontally burned LED lamp with two forward facing LED mounting faces in a luminaire with reflector, according to an embodiment of the invention.

Figure 20:
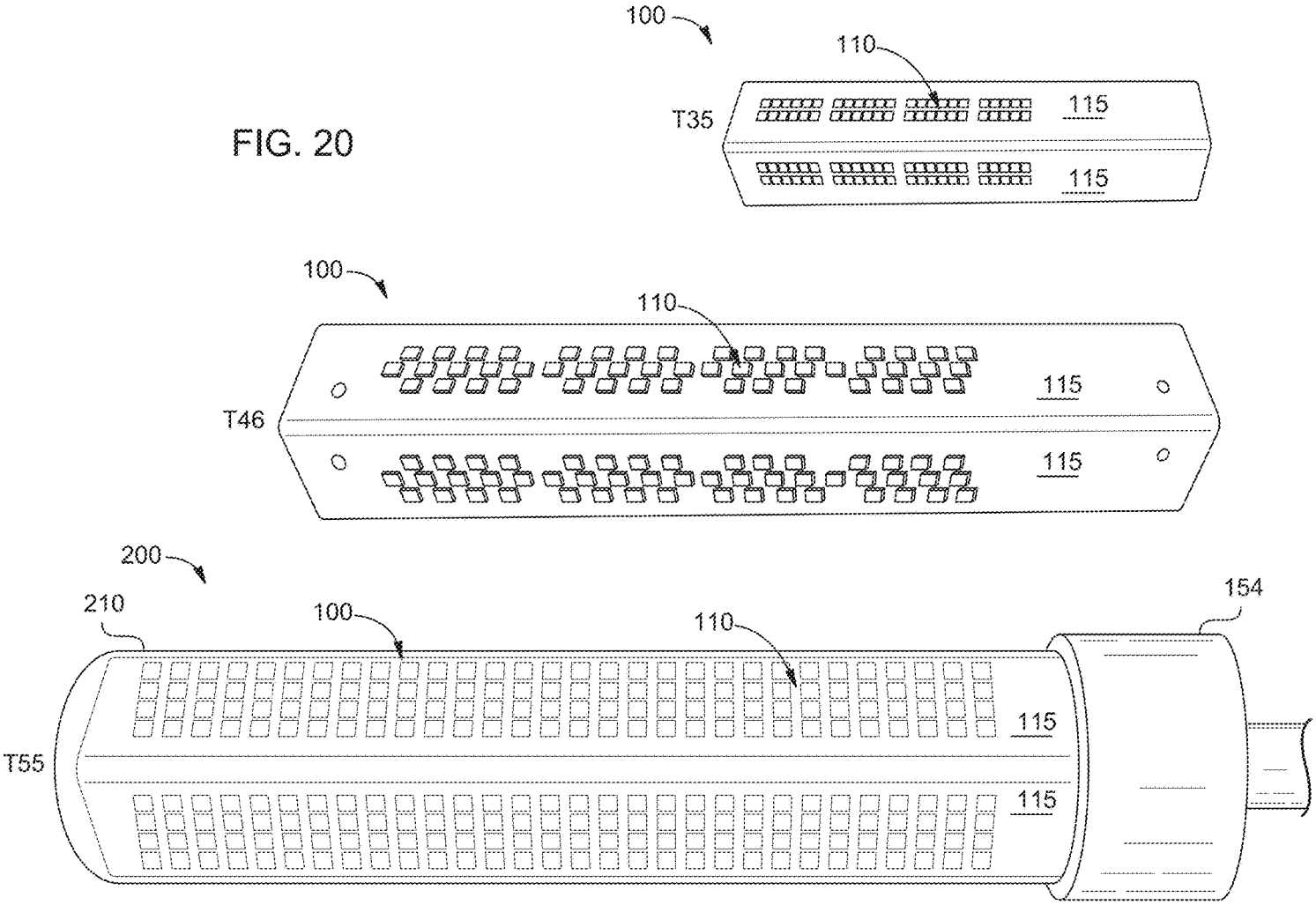

FIG. 20 is a side view of a T55 lamp compared to T35 and T46 lamp LED modules, all according to embodiments of the invention.

DETAILED DESCRIPTION OF THE INVENTION

The following table is a glossary of terms and definitions, particularly listing drawing reference numbers or symbols and associated names of elements, features and aspects of the invention(s) disclosed herein.

| REF. | TERMS AND DEFINITIONS |
|---|---|
| 100 | LED Module |
| 102 | LED carrier (folded MCPCB) |
| 104 | MCPCB, metal core printed circuit board. Also MCB, metal PCB, and the like. |
| 106 | grooves in the MCPCB used to thin the metal on the inside of the folds (folding lines) |
| 110 | LED (Light Emitting Diode) for mounting on a printed circuit board |
| 112 | Edge of the prismatic carrier, a fold/bend line, designated E1 to E(N + 1) in numeric order starting and ending with the "back edges" 116, and the prism has an N-sided irregular and incomplete polygonal cross section |
| 114 | Side of the prismatic carrier, flat face between edges, designated S1 to S(N) in numeric order starting and ending with the "back edges" 116. Is a "mounting face" 115 when LEDs are operationally mounted on it. |
| 115 | mounting face or side, side of the LED carrier 102 that is used to mount LEDs |
| W | Width of a side/wall/tab of the carrier, may be designated according to side, e.g., W(S1) |
| D1 | Cylindrical inside diameter of the glass jacket 210 |
| D2 | Diameter of a circle that circumscribes the carrier 102 when it is installed in the glass jacket. Preferably equal to glass jacket diameter D1 |
| D2' | Diameter of a circle that circumscribes the carrier 102 when it is in an unbiased neutral state, e.g., after being folded but before being inserted into the glass jacket. Preferably the MCPCB is resilient with a spring bias toward the neutral state, and D2' is greater than the jacket inside diameter D1. As a result, the module is in a constricted state when inside the jacket, thereby biasing the fold edges into thermal contact with the jacket wall, and providing friction to hold the LED module in a predetermined longitudinal position within the jacket. |
| GAP1' | separation of the spaced-apart back edges when the carrier is in an unbiased neutral state. Preferably GAP1' is greater than GAP1 because D2' is greater than D2. |
| GAP1 | separation of the spaced-apart back edges, creates an opening for gas convection into or out of the interior cavity. |
| GAP2 | optional separation where the back edges are preferably spaced inward from the cylindrical diameter (D1) of the glass jacket inside surface. |
| 116 | Back edges = edges where the incomplete polygon is open to an interior cavity 124 |
| 118 | front side(s) distal to the back edges 116. For an even number N of sides 114 here are two front sides 118 corresponding to the two back edges 116. Otherwise there is only one front side. (see FIGS. 3, 4, 8A-8G) |
| 120 | interior wall(s) (at least one, optionally two) extend from at least one of the back edges 116 inward toward a distal front side 118. May be designated as walls I1 and I2. |
| 122 | thermal attachment tab (optional), bent to extend from the interior wall 120 along the inside surface of the front side 118 for thermal attachment, thereby additionally heat sinking the front side. May be designated as tabs T1 and T2. |
| 124 | interior/center/chimney cavity open at the back edges 116 for enhanced "chimney effect" convection. The carrier structure is divided by the interior wall(s) 120 into an open center cavity 124 flanked by at least one side cavity 126. |
| 126 | side cavity, a subdivision of the interior of the LED module 100, typically closed relative to the back edge 116 openings GAP1 and GAP2. |
| 128 | thermal attachment/fastener. May be mechanical (e.g., rivet, screw), or other suitable means (e.g., weld, solder, adhesive), and may include thermal conductivity enhancement (e.g., thermal grease/paste) |
| 130 | hole for mechanical fastener |
| 132 | metal wool, a high thermal conductivity metal (e.g., aluminum or copper) in a porous but highly interconnected form, filling cavities and firmly contacting the MCPCB 104 walls that surround it. |
| 136 | dielectric coating on the LED mounting surface of the MCPCB, preferably polyimide |
| 138 | circuit traces interconnecting electric components on the MCPCB, preferably without a solder mask layer |
| 140 | LED driver circuit mounted on the MCPCB. Includes rectifier so that AC line voltage can be directly supplied to the LED module through the lamp lead wires |
| 142 | lead wires |
| 144 | fused glass seal (bulb neck heat fused to stem flange), typical way to get a hermetically sealed lamp |
| 146 | lamp exhaust tube |
| 148 | breathable plug/membrane, methyl silicone (2-part curing) |
| 150 | adhesive/sealant used in base, preferably breathable silicone |
| 152 | breathing/vent hole (in base) |
| 154 | lamp base (any kind) |
| 156 | plastic base/cap/collar |
| 158 | thermally conductive plastic material in base |
| 160 | water blocking porous ceramic material used in base |
| 162 | getter in lamp for capturing volatile materials (e.g., desiccant, silica, active carbon, natural zeolites, de-aluminized zeolites (hygroscopic), surface treated zeolite) |
| 164 | electric insulator |
| TCA | thermal contact area, either direct (d) or indirect (i) contact of carrier with thermally conductive base. Indirect is through intervening glass jacket. |
| 170 | luminaire, lighting fixture, housing |
| 171 | fixture reflector |
| 172 | fixture socket |
| 174 | metal strap or clamp used in fixture to establish thermal contact of lamp base and/or LED carrier to heat sinking body of fixture |
| 200 | Glass jacketed LED lamp |

-continued

| REF. | TERMS AND DEFINITIONS |
|---|---|
| 210 | glass jacket (GJ), preferably a tubular "T" bulb, straight sided without a neck, optionally domed on one end. Generically referenced as "outer jacket (OJ)", "jacket", "envelope", or "bulb" - which aren't necessarily made of glass. |
| 212 | Open end of tubilar jacket 210 |
| C | Center axis of cylindrical glass jacket, cylindrical/longitudinal axis |
| N | integer referencing the number/quantity of sides 114 or edges 112. For example, FIG. 4 shows a shape having N = 6 sides as labled. Also there are 7 edges, the seventh being lables E7 and E(N+ 1). Thus "N + 1" equals one more than the quantity N. |
| Angle1 | face angle, corner, angle: is the angle of the LED Mounting Face 115 relative to the forward direction |
| BEAM SPREAD | extent of LED module's light output expressed as an angle around the cylindrical axis C, assuming a 180 degree angular extent of light output from LEDs on each LED mounting face 115, and combining overlapping angular extents of all mounting faces as shown in FIG. 3, where two mounting 115 intersect at two times their face angles ANGLE1. |

The invention(s) will now be described with reference to the drawings using the reference numbers and symbols listed in the above table.

The present lamp design started with a goal of designing an HID LED replacement lamp with different technical solutions including thermal management and optical optimization under the condition of keeping the traditional HID glass jacket (bulb) shape, and sealed with a gas filling and using a metal base such as a screw threaded mogul or medium base.

Fundamentally, our approach is to lower the thermal resistance between the LEDs mounted inside of a glass jacketed LED lamp, and the ambient air outside the glass jacket. The following three focuses were presented as major objectives of the early work:

- Obtain higher equivalent thermal conductivity of thermally conductive gas filling.
- Increase the gas convection coefficient inside the sealed glass jacket.
- In addition to gas conduction/convection transferring heat from LEDs to glass jacket and from the GJ to ambient air; utilize other thermal pathways to the outside.

Heat Conducted by Gas Filling

Helium and H2 may be applied as internal conductive gas transporting heat from LED source to glass jacket. Glass jacket behaves the function to dissipate heat to outside air.

The glass jacket is a good heat sink due to its large surface area and thermal conductivity of ~1 W/mK. Although this glass thermal conductivity is relatively low, the effective total heat transfer can be large because the glass is thin (e.g., about 1 mm) and convective heat transfer both inside and outside is magnified by the large glass jacket surface area exposed to air flow.

A thermally conductive LED carrier 102 is applied in lamp, like a folded MCPCB 104 (Metal Core Printed Circuit Board). This is typically made of aluminum which has a high thermal conductivity to take heat away from LED junctions and spread it over large surface area of the PCB (printed circuit board, assumed in this disclosure to be made of metal=MCB). The large surface area increases the total convective heat transfer to surrounding gas filling.

The MCPCB 104 is a printed circuit board (PCB) made of metal instead of fiberglass/epoxy, and may be abbreviated as "MCB" for metal core board or metal circuit board. The MCPCB may be referenced herein by various terms including MCPCB, Metal PCB, MCB and even simply as a PCB, but all such terms should be understood as references to the same thing (the Metal Core Printed Circuit Board 104).

In an embodiment, electrically conductive and highly thermal conductive metals like copper, Al or tungsten or their combination are used as MCB supports and electrical leads that pass through the sealing stem to be connected with lamp base (see FIG. 1A, 1B). In this way, heat may be conducted out to the base.

Unfortunately heat created during lamp glass sealing can be conducted in to the MCB and LEDs to damage LEDs both by overheating and by causing the MCB coatings to outgas and the gases may also damage the LEDs. Furthermore, the sealing heat can be carried by gas convection. A heat shield is one of several ways that were considered for combating this problem.

The other important factors needing to be controlled are Helium pressure and gas flowing path inside lamp, since HID replacement lamp has bigger volume glass jacket compared with regular A19 lamp, which could be applied to build an internal He flowing path including inlet/outlet under high pressure, like 5 atm. The thermal resistance through the gas obviously depends on its thermal conductivity and the magnitude of the natural convection within the bulb from helium. If with similar temperature change and difference within internal He environment, the natural convection coefficient will be greatly increased under higher pressure of Helium and related with internal glass jacket & metal grids design. By theoretical calculation, 5 atm pressure can create 20× increase on nature He convection coefficient vs. regular 1 atm. For example, double layer jacket with built in air flow path can match well LEDs and related metal grids from air dynamic flowing point of view.

To utilize higher pressure Helium inside glass lamp, it does not contribute much to He thermal conductivity increase but can definitely increase internal natural convection coefficient, and improve the He diffusion into LED encapsulation silicone and soldering material and decrease the thermal resistance in silicone and soldering layer due to its 7× higher K than air. However, it brings risks on possible gas leaking due to pressure difference between interior and exterior glass lamp, and mechanical stress added on LEDs soldering, silicone and package materials etc.

Metal Grids/Surfaces/Structures

As mentioned above, helium may be applied as thermally conductive gas or major thermal path to dissipate heat flux created from LEDs to glass jacket. The thermal resistance through the gas obviously depends on its thermal conductivity and the magnitude of the natural convection within the bulb. Due to closed environment and limited volume size of glass bulb, it is not easy to improve magnitude of the He natural convection coefficient, therefor the effective thermal conductivity of the bulb fill gas is a major path to minimize the thermal resistance between LEDs and glass jacket.

Longitudinally extending metal components such as the frame, and also tubular surfaces such as the shroud, can enhance thermal dissipation from lamp bottom to top and effectively decrease the thermal resistance, or increase the effective thermal conductivity of gas in vertical direction. They spread out the contact area and also provide a "chimney effect".

Certainly, the goal is to utilize various internal metal surfaces inside glass jacket to effectively decrease thermal resistance between LEDs to glass jacket in different directions. It is not limited to only utilize thermally conductive metal based side supports and shroud supports shown above. For example, their shape and structure can be optimized to match with LEDs distribution/thermal source distribution to further enhance not only effective thermal conductivity of gas, but the helium convection coefficient in glass bulb, especially the area close to glass jacket, and to further decrease the thermal resistance between LEDs and glass jacket.

In addition, metal surfaces that directly contact with glass jacket 210 internal surface will benefit by directly conducting heat from metal to glass. The contact can be mechanical contact by direct touch or with thermally conductive material in between.

Example

An embodiment of an LED replacement lamp 200 for high power HID lamp is presented with reference to top and side cross-sectional views shown in FIGS. 1A and 1B respectively. This embodiment is a schematic representation of one example implementation of the inventive concepts hereindisclosed, particularly showing how to effectively decrease thermal resistance to heat transfer from LEDs to glass jacket using conduction and fill gas convection.

A stem and lamp base and electrical connectors etc. would normally be at the base end (left of FIG. 1B) but is omitted to focus on the LED lamp structure relative to the glass jacket 210. Also, the glass jacket is illustrated in a simplified form with sharp corners and straight sides rather than the more complex, rounded profile of a typical glass jacket. The cross-section view is taken along the line 1B-1B shown in FIG. 1A.

Important features/aspects include:

- Use an octagon shape folded, thermally conductive PCB 102 (not limited to an octagon shape) as LED carrier with hollow center structure (or PCBs mounted on shaped metal tube with hollow center) to create effective air flow path inside bulb and increase the internal filled gas convection coefficient, and behave as metal grids/surfaces to increase effective heat flux dissipation area below heat sources (LEDs), i.e. to lower the thermal resistance created in the volume included by folded PCBs, and also to get uniform light distribution by matching well with glass jacket 210 shape because the PCB is closer to being cylindrical due to the eight or more sided tubular shape.
- Decrease the distance between folded PCB 102 to glass jacket 210 to further lower the thermal resistance through filled gas. The multi-sided PCB enables this, especially when used in straight sided cylindrical-tubular outer jacket 210.
- LEDs on the PCB 102 (e.g., LEDs 110 assumed but not illustrated) can be directly touching the glass jacket 210 with minimum or without air gap by using additional refractive index matching compound (e.g., a liquid or paste).
- A metal dish attached at top of metal frame and designed to touch as much as possible of the internal top surface of the glass jacket.

Some of the early developmental work (e.g., FIGS. 3 and 19) focused on replacing a horizontal burning, tubular high wattage HID lamp, most particularly the 1000 Watt Double Ended (DE) HPS horticultural lamp that has a tubular quartz envelope/bulb/jacket/OJ 210 with a single lead wire exiting a quartz pinch seal at each end. It can be seen, however, that the scope of the innovations presented herein are applicable to a broad variety of LED lamp 200 embodiments comprising LEDs 110 mounted on a PCB 104 that is positioned inside an outer jacket 210 (particularly a glass, not quartz, jacket) that has at least a portion that is cylindrical/tubular in shape. Especially notable is the use of LEDs mounted only on forward/downward facing "front" sides 118 of the LED carrier 102 (folded MCPCB 104) to achieve a directed beam of light output without needing to use a fixture reflector.

Embodiments of important parts of a glass jacketed LED replacement lamp 200 are now presented with particular reference to an end view and a perspective view shown in FIGS. 2A and 2B, respectively. The illustrated embodiment represents example implementation(s) of the inventive concepts hereindisclosed, particularly showing internal lamp structure to effectively decrease thermal resistance to heat transfer from LEDs to glass jacket using thermal conduction and fill gas convection. A pinch seal and electrical connectors etc. would normally be at one or both ends but is omitted to focus on the LED lamp structure relative to the glass jacket 210. As in FIGS. 1A-1B, LEDs 110 are not shown, but are assumed to be mounted on at least one of the outside surfaces, e.g., as shown in FIG. 3.

Referring particularly to FIGS. 5A-5B, the outer jacket is "glass" (e.g., hard glass) instead of quartz, because the LED heating of the jacket 210 is so much less than for the HPS lamp. For lower thermal conductive resistance, we minimize the thickness of glass, constrained by physical requirements such as strength, fragility, durability. Before sealing, the jacket 210 is preferably a cut length of tubing stock with a constant diameter and a center axis C, but at a minimum it has at least one end with an opening at least the same inside diameter D1 as the body of the jacket. The other end may be domed as with a typical "T-bulb". This is so that the internal structure, the LED carrier 102 of the LED module 100, can be pre-forming to a shape that will have a maximum outside diameter D2 that is approximately equal to the jacket inside diameter D1 when inserted into the jacket 210 coaxial to the center axis C (thereby enabling direct contact between structure edges 112 and the glass 210 as shown, for example, in FIGS. 5B and 10). The internal structure (i.e., the LED carrier 102) is formed as a convex prismatic polyhedron, and the prism cross section is an incomplete (optionally irregular) polygon (two sides are separated by "GAP1"). As shown in FIGS. 5A-5B the structure 102 is advantageously pre-formed to make its pre-formed diameter D2' slightly greater than the jacket inside diameter D1 so it can be constricted enough to slide into the jacket 210, then released, thus using its spring-back force as a bias to hold the LED carrier 102 in position by friction. This avoids the need for the base to support the internal structure. Even better, this bias force also establishes firm contact of the edges 112 to the jacket 210 to maximize thermal conductivity, i.e., most if not all of the edges 112 are in what we term "thermal contact" with the jacket wall. As shown in FIG. 10, two of the edges 112 are "back edges" 116 that may be spaced inward from the jacket by a distance GAP2. However, that is optional as can be seen by comparing FIG. 8A to FIG. 8B that has substantially the same structure except that there is no GAP2 (i.e., equals zero) so that all edges 112 will contact the jacket inside diameter (including the back edges 116).

Regarding the internal structure of the lamp 200, our approach is to utilize both conduction and convection to transfer heat from the LED backplane (MCPCB) to the envelope 210 so that it can disperse that heat from its outside surface. As described hereinabove, helium gas filling may be used to increase convective heat/thermal flow, although our later development followed a different route wherein the lamp does not have a hermetically sealed fill gas.

Referring to FIGS. 6A and 12A, the LEDs 110 of the light source (LED module 100) are mounted on a metal printed circuit board (metal PCB a.k.a. MCB, or MCPCB for metal core PCB) 104 using conventional means including a dielectric surface coating 136 between the metal (aluminum or copper) backplane and the electric circuitry traces 138 printed thereupon. The metal board is used to provide a heat sink for the LEDs 110. In an embodiment, a polyimide dielectric layer 136, and copper traces 138 without a solder mask are used, thereby enabling MCPCB bending without cracking, and minimizing potential VOC emissions.

FIGS. 6A-B, 9A-B and 12A-B show MCPCBs 104 that have been prepared according to embodiments of the invention (also shown schematically in FIG. 7). The plan views show folding lines (e.g., grooves) 106 that divide it into lengthwise sections (e.g., sides 114, S1-S6), for folding. Examples of LED 110 placement are indicated by symbols. Driver 140 and circuitry 138 are not shown except in FIGS. 12A (and 12C). The quantity and arrangement of LEDs 110 is a function of lamp radiant output specs. Optionally, where those specs allow LED and circuitry placement on some, but not all sections 114, then only the LED mounting faces 115 may be coated with dielectric material 136 for application of circuit traces etc. used for LED mounting. This not only reduces cost and improves bendability of the MCB 104, but may also reduce potential outgassing or other problems that might be caused by the coating. Furthermore, uncoated aluminum surfaces are expected to have less thermal resistance to heat transfer (by conduction to gas filling and glass or metal surfaces in thermal contact, and/or emissivity for thermal radiation/IR) away from the MCB which is also the heat sink for the LEDs.

As seen in FIGS. 6A-B the LED placement on only two sides 114 (e.g., "front side" 118 mounting faces 115) enables concentration of all lamp radiant output into a generally forward direction without any losses from reflection by an external reflector. Also viewing FIG. 3, the face angle "ANGLE1" is the angle of the LED mounting face 115 relative to the forward direction (e.g., downward or vertical), and this controls beam spread independently of the fixture reflector (although a reflector could be used to limit/reduce beam spread for a given lamp design, as can be seen by comparing FIG. 19 to FIG. 3). Thus ANGLE1 depends on the light distribution requirement (beam spread), which is related with LEDs location and their view angles as well. In general face angle ANGLE1 may be anywhere from 0 to 90 degrees, but practically speaking will be around 30 degrees or more because zero degrees would place the LED backplanes against each other and eliminate the central "chimney" for heat sink cooling. In our testing, a prototype example embodiment exhibited a beam spread of roughly 270 degrees (+/−135 degrees about the forward direction). (See "BEAM SPREAD" as labeled in FIG. 3.)

As shown in FIGS. 4 and 7, and where the symbol '#' represents an indexing number, the placement of folding lines 106 (which produce edges 112 after folding) determines the width "W(S#)" of each section/side 114, S# and the magnitude of parameters such as ANGLE1, GAP1, and GAP2. Varying the quantity of grooves 106 changes the number "N" of sides 114 in the overall polygon shape. Several examples are shown in FIGS. 8A-8G, which illustrates 3 to 6-sided polygons. These variations should be bounded by design constraints as follows (also referring to FIGS. 2A-6B):

- The outside corners (edges) 112 of the structure should be as close as possible to touching the ID of the outer jacket 210, with the exception of the back edges 116 which may have certain gap spacings.
- The ANGLE1 (determined by beam spread requirement) is fixed by the width of the two LED mounting faces 115, i.e., the two sides of an isosceles triangle that is formed within the jacket ID around a vertex angle of 2×ANGLE1.
- The back edges 116 should be spaced apart by GAP1 dimension and should be spaced away from the jacket ID by a GAP2 dimension (optionally zero).
- The inside walls 120 (I1, I2) should form a chimney cavity 124 such that heat rising from back of the LED mounting faces 115, enhanced by a chimney effect, will circulate up to the jacket 210 through GAP1 and also spread around the jacket ID by passing through GAP2 on either side. This convection cooling also removes heat that is conducted away from the LED backplane by the inside walls of the cavity.
- The width of the MCB thermal attachment tabs 122 (T1, T2) may be adjusted to control the mass of aluminum present as a double wall thickness behind the LEDs, noting that varying this will also vary the vertical angle of the inside walls 120 of the chimney cavity.
- The thermal attachment tabs 122 may be fastened securely to the back of the front sides 118 (mounting faces 115) in a way that maximizes the thermal conductivity therebetween, thereby optimizing the heat sinking capacity of the metal mass behind the LEDs. (This also helps stabilize and fix the structure shape and dimensions.) Suitable fastening means may include rivets or screws 128 in holes 130 (FIGS. 6A-6B, 7), welding, soldering, thermally conductive adhesive, and the like. The illustrations of mechanical fasteners may show a single fastener 128 and hole 130 at each end of the LED mounting face 115 but this is merely representative of any suitable number and placement of such fasteners.

The above description focuses on horizontal burning with the gaps GAP1 and GAP2 providing a chimney cavity 124 opening (GAP1 between back edges 116) that is vertically "on top". It should be noted, however, that the disclosed structure of the folded PCB 102 will provide cooling with enhanced convection regardless of the burning orientation. This is because the structure is open on both longitudinal ends such that the lamp fill gas will circulate into and/or out of the ends as well as the longitudinal edge GAP1. For example, if burned horizontal with the gaps axially rotated to a position in the top 180 degrees, then gas will most likely flow into the cavity from one or both ends and out through the gaps at top. If the gaps are located within the bottom 180 degrees, then circulation may reverse direction. Vertical burning provides the most options for gas flow paths from bottom to top through some of the channels and returning downward through others, the channels being bounded by any of the side walls 114 of the PCB and the inside wall of the surrounding glass jacket 210.

Referring to FIGS. 4 and 6-9, although the LED support structure 102 (folded MCPCB 104) may be loosely described herein as a polygon or a hexagon or an octagon (i.e., polygonal cross section profile of a polyhedron), the preferred structure should be interpreted in light of the drawings and description that discloses a polyhedron that is preferably open, not closed (e.g., at GAP1), and may be irregular as well, i.e., unequal width W(SN) sides 114, S(N) and unequal corner angles (i.e., angles formed by the edges 112, E(N)). We have presented a profile having a plurality (quantity N) of substantially straight sides 114, S (e.g., N equals six) around the outside perimeter but preferably having extra sides (interior walls 120, I1, I2) that extend into the interior cavity from a gap (e.g., GAP1) between adjacent sides, thus leaving the outer polygon open, not closed. The outer polygon may have substantially equal width sides (FIGS. 8A-9B), or unequal widths (FIGS. 6A, 6B, 7). The unequal widths may be best for support structures having LEDs mounted on some but not all of the sides 114, in which case the LED mounting sides 115 (e.g., sides S3 and S4) may have widths W (e.g., W(S3) and W(S4)) designed to achieve a particular corner angle (e.g., ANGLE1, which produces a desired BEAM SPREAD). For example (see FIG. 4), dimensions for a 6-sided (N=6) MCB in T46 or T55 bulbs: width W(S1) through W(S6) of exterior sides 114 is bigger than 10 mm, while the interior side walls 120 are at least 30-50 mm wide (W(I1), W(I2)). Side widths may also be determined by other objectives such as those listed above. For example, a lamp designed for vertical burning may not need the open corner or interior walls 120 (although they are preferred), and may have more sides 114, potentially having equal width (e.g., eight as shown in FIG. 1A) such that all of the structure corners/edges 112 can touch the jacket wall 210, or be equidistant from it as shown. In another embodiment, the structure may be shaped such that LEDs 110 mounted on each side can touch or be optimally close to the outer jacket wall 210 for additional heat sinking.

A common factor among the disclosed LED support structure 102 embodiments is that the structure is formed by folding a single sheet 104 of MCPCB material (e.g., as illustrated in FIG. 7), generally after the electrical elements such as LEDs 110, circuitry traces 138 and the like have been mounted thereupon. As described hereinbelow, the mounted electrical elements may include LED driver 140 circuitry and components (i.e., a "driver on board"). Referring to FIG. 12A, it can be seen that placement of LEDs, drivers and other elements on a plurality of folded PCB sides 114 and interior walls 120 will preferably utilize electrical conductors (traces 138) that are "printed" on the PCB 104 surface in paths that extend across the fold 112 (above groove 106) between adjacent sides 114. This means that the folds 112 must be gentle curves that do not stretch, wrinkle, or otherwise potentially damage electrical continuity of the traces 138. Thus the "grooves" 106 are cut into the side opposite from the mounting surface having the traces 138 and the LEDs 110 in a way that prevents metal from bunching on the inside of the bend because that might stretch the mounting surface. Furthermore, these considerations may be modified to accommodate changes of the MCPCB board 104 in order to reduce VM (volatile material) emission inside the lamp 200.

FIGS. 8A-8G schematically show several example embodiments of the inventive LED carrier structure 102 with a folded MCPCB 104, where 8A-8D show incomplete 6 sided polygon profiles (N=6), and 8E, 8F, and 8G show 5, 3, and 4 sided profiles, respectively. These figures show how the front side(s) 118, distal to the back edges 116, change widths and angles as the number of sides 114 is changed. The figures also show variations in the number of interior walls 120 and tabs 122.

Getters in GJ LED Lamps

The heat of sealing can damage the MCPCB 104 directly (e.g., blackening the surface). Furthermore heat from sealing and heat from burning the LEDs may result in outgassing, i.e., emission of volatile materials (VMs) such as VOCs (volatile organic compounds) and water (vapor) from lamp components such as the MCPCB/LED carrier 104/102, LEDs 110, and/or glass jacket 210 (particularly from materials used in some adhesives, coatings, gaskets, plastics, solder flux, solder mask, conformal coating, dielectric coating 136, and the like). There may also be humidity (water vapor) in the gas filling (especially if lamp is vented to ambient air). If not prevented or eliminated then the VOCs and water attack and degrade the MCPCB and LEDs. For example, VOCs and/or water vapor may penetrate into the LEDs (e.g., permeating through a silicone lens) causing aging, shortened life, color change, and/or rapidly decreasing light output due to corrosion and/or chemical reactions. Furthermore, liquid water (e.g., condensed water vapor) can cause shorting of circuitry, especially if LED driver circuitry 140 is inside the lamp. Byproducts of chemical reactions with VOCs also may be deposited on the bulb 210 inner wall, causing blackening which decreases light output.

VOCs may outgas, for example, from elements typically associated with a PCB (MCPCB) 104, e.g., a dielectric coating 136, solder, flux, and/or solder mask materials. Therefor one way to reduce outgassing is to minimize if not eliminate the outgassing source materials. For example, the MCPCB may be bare metal (without coatings etc.) on all sides 114 except where needed to mount and electrically connect the LEDs on the LED mounting face(s) 115, e.g., just the two middle sections of the board as shown in FIG. 6A, or all of the sides 114 and walls 120 that will have electrical traces 138 printed on them as shown in FIG. 12A.

Outgassing is a function of time and temperature, therefor another way to reduce outgassing is to minimize the operating temperature of the outgassing source materials. Our folded MCPCB (i.e., the LED carrier 102) design provides a very efficient heat sink which minimizes operating temperature of the LEDs. Heat sink efficiency is optimized by several of our design factors, including for example:

- very large MCPCB surface area that is exposed to gas convection cooling, including extra area along the interior cavity walls 120,
- unusually effective heat transfer to the outer jacket 210 by conduction from long edges/corners 112 of the MCPCB that are spring biased to be held firmly in contact with the jacket 210.
- extra paths for conducting heat away from the LEDs 110 (tabs 122 on interior walls 120 attached to back of LED mounting sides 115)
- metal wool 132 benefits two ways: extra paths for conducting heat away from the LEDs, plus a very large effective surface area for gas convection cooling chimney effect along multiple paths in and around portions of the MCPCB (cavities 124, 126, GAP1, GAP2, and space between the MCPCB outside walls 114 and the nearby jacket 210 wall.)

long edges 112 of folded MCPCB firmly held in contact with jacket wall 210 optional driver on board 140 is mounted on cavity interior wall 120, not close to LEDs (as shown in FIG. 12C).

Additionally, it may help to pre-treat any potential VM (volatile material) emitting materials to remove as much as possible of VMs before sealing the light source into the outer jacket 210. For example, the LED module 100 can be baked at elevated temperature before enclosing it in outer jacket and base or glass seal.

In addition to the abovedescribed methods for preventing and/or minimizing VM contamination, sealed LED lamps 200 may need methods for removing and/or preventing the accumulation of harmful contaminants (e.g., VMs) inside the jacket 210 over the life of the lamp. Contaminant removing components are typically referenced as "getters" in lighting products, wherein a getter functions by trapping and holding the contaminants, thus removing them from the lamp filling.

It may be noted that, in prior art LED lamps, use of getters for contaminant removal are typically not mentioned, likely because, for example, the prior art LED modules may not get as hot (e.g., with external heat sinking or low wattage), and/or VM emission is at a low rate that can dissipate and/or be diluted to harmless concentrations by a relatively large volume enclosure (which may be vented and/or not completely enclosed). For example, U.S. Pat. No. 8,757,839 by Hussell (Cree) discusses potential VOC contamination in column 11 of the detailed description, however they solve the problem by other methods, such as adding oxygen, or a blocking substance added to the LED. We note that they are only looking at relatively low wattages, i.e., the LED equivalents for 60 W and 40 W incandescent lamps. (A typical 60 W equivalent outputs 800 lumens and consumes about 9.5 W total). We are dealing with much more heat in the envelope, e.g., up to 50-60 W of LED operating power. Therefor we believe getters are needed, especially in sealed enclosures.

The VMs typically include both high polarity types (e.g., acetone, methyl/ethyl alcohol and water); and low polarity types, (e.g., hexane, toluene, etc.). To getter the VOCs, our research concludes that a combination of active carbon, natural zeolites, de-aluminized zeolites, and/or surface treated zeolite like organic hydrophobic silane should be effective for minimizing lamp damage due to outgassing. Active carbon is a universal adsorbent of VMs due to its non-polar surface affinity and random mixture of pore sizes. Furthermore, a desiccant (e.g., silica) is highly hydrophilic and therefor particularly effective in adsorbing water preferentially over the VOCs likely to be in the lamp. Therefore the desiccant can handle large amounts of water, preventing the other getters from being overwhelmed by water, so they can focus on VOC adsorption. Zeolites are three-dimensional, microporous, crystalline solids with well-defined structures that contain aluminum, silicon, and oxygen in their regular framework. The silicon and aluminum atoms are tetrahedrally coordinated with each other through shared oxygen atoms. Zeolites are natural minerals that are mined in many parts of the world; but most zeolites used commercially are produced synthetically. Zeolites have void space (cavities or channels) that can adsorb cations, water, or other molecules. Because of their regular and reproducible structure, they behave in a predictable fashion. Zeolites can separate molecules based on: size, shape, polarity, and degree of unsaturation, among others, thus may be called "molecular sieves".

In addition to selectivity based on size and configuration, zeolites will preferentially adsorb molecules based on polarity and degree of unsaturation in organic molecules. In a mixture of molecules small enough to enter the pores, the molecules with lower volatility, increased polarity, and a greater degree of unsaturation will be more tightly held within the crystal. Therefor we conclude that pore size should be bigger than VM molecule size in order to trap them.

All naturally occurring zeolite contains aluminum and is hydrophilic (having an affinity for polar molecules, such as water and some of the VOCs.) De-aluminizing natural zeolite makes it hydrophobic (having affinity for non-polar substances, such as many of the VOCs). Zeolite is de-aluminized by chemical replacement of aluminum with silicon without changing the crystal structure.

Activated/active carbon has been treated to create a very large surface area available for adsorption and/or chemical reactions. The surface area comes from a randomly complex structure that has a large quantity of pores that may be various sizes (micro-pores, macro-, etc.). Adsorption by trapping in pores occurs similarly to zeolites, except that it has a neutral (non-polar) surface affinity making it potentially a universal adsorbent of all VMs including water.

Desiccants are solid materials that adsorb water (are hydrophilic). Thus, certain zeolites and forms of active carbon can be used as desiccants, but other materials are also available for this specific purpose. Silica is a well known, excellent desiccant. It is porous and polar and has a strong affinity for water. Advantages include:

it is not used up by adsorbing anything other than water molecules chemically inert high capacity for retaining adsorbed water captures both liquid and vapor forms of water inexpensive and readily available in a variety of forms, e.g., crystalline, gel, in capsules, in flexible skins, etc.

Therefor we conclude the following:

Zeolite pore size should be bigger than 4 A to trap expected VMs.

Hydrophilic & hydrophobic zeolite should both be used because expected VMs include both high and low polarity molecules.

Active carbon can be used to supplement zeolites for maximum adsorption of all VMs.

Desiccants can be used to prevent other getters from being overwhelmed by water.

Figure 14C:
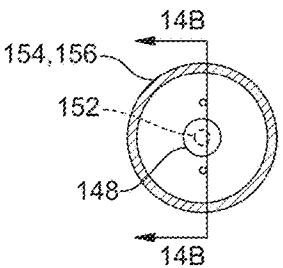
Figure 14B:
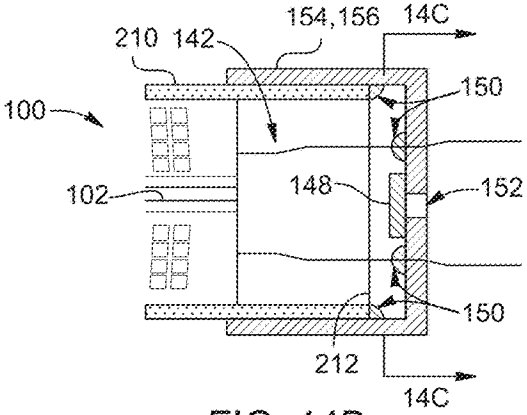
Figure 14A:
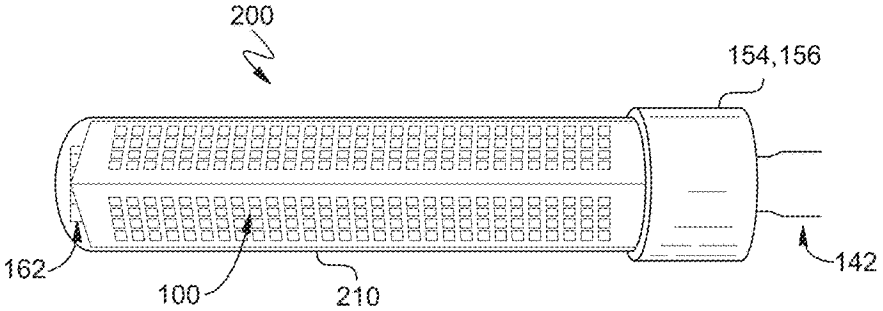

Referring to FIG. 14A, the getter(s) 162 are preferably positioned at the lowest possible temperature location in the operating lamp 200, (e.g., as shown at an end of a horizontally burning lamp 200) in order to avoid releasing the gases that have been adsorbed.

The description so far assumes that the outer jacket (bulb) 210 is hermetically sealed (e.g., using a fused glass seal 144 as shown in FIG. 13A, except that the exhaust tube 146 would also be tipped closed to complete the hermetic seal), and filled with an inert gas, preferably one that has a high thermal conductivity and/or which enhances convective heat transfer from the LEDs 110 and MCPCB 104 (i.e., the LED module 100) to the bulb 210. Helium and hydrogen are particularly suitable.

Metal Wool Heat Conductive Filling

In the previous description referencing FIGS. 2A-9B, the interior sides (cavity walls) 120 of the LED carrier structure 102 (bendable/folded MCPCB) are presented as heat sink surfaces that are attached (via tabs 122 and fasteners 128) to the back of an LED mounting surface 115. They can conduct LED waste heat away and spread it out along the wide wall where gas convection may transfer the heat out to the glass jacket 210. This heat sinking is most effective for the MCPCB outer sides 114 to which the interior walls 120 are fastened, for example the two LED mounting faces 115 on the front sides 118. However, at least two of the outer sides 114 are not directly attached to an interior side wall 120, but they may also have LEDs 110 mounted on them. For example, FIG. 9A shows an MCPCB 104 with six sides 114 (i.e., quantity N of sides equals 6), where LEDs 110 are mounted on all six outer sides 114 making them all mounting sides 115. Referring also to the 6 sided folded MCPCB 104 in FIG. 4, it can be seen that the front sides 118 (i.e., the third side S3 and the fourth side S4) will be cooled by attachment to the tabs 122 (T1, T2) when folded. The first and last (Nth) sides 114 (S1 and S6) are cooled by conduction to adjacent interior walls 120 (I1 and I2). However the second and fifth sides 114 (S2 and S5) are adjacent to LED mounting sides 115 in both directions so they are not cooled by conduction to non-LED mounting sides. Therefor an added way to enhance heat sinking of all the MCPCB walls/sides 114, 120 is presented: As schematically illustrated in FIG. 10, a thermally conductive light weight material 132 is used to fill cavities (e.g., center cavity 124, and two side cavities 126) inside the folded MCPCB carrier structure 102. In a preferred embodiment the filler 132 is a high thermal conductivity metal (e.g., aluminum or copper) in a porous but highly interconnected form such as "wool" (or mesh or yarn and the like). The metal wool 132 should fill the space, firmly contacting the MCPCB walls 120, 114 that surround it, thereby increasing the effective thermal conductivity of the gas/air filling without increasing lamp weight much. Also, because it is porous it becomes an extremely good means for convective heat extraction by any circulation of the fill gas through the wool-filled cavity. Suitable metals or alloys preferably have a thermal conductivity greater than 10 W/mK.

This approach can significantly decrease the localized LED temperature even when using air instead of more conductive/convective gas fillings like He or Hydrogen that have higher thermal transfer rates. For example a 27 W T46 LED lamp 200 was tested (e.g., the middle LED module 100 in FIG. 20, enclosed in a 46 mm outside diameter T (tubular) bulb 210). It had two LED mounting faces 115 and an integrated AC direct LED driver 140 mounted on one of the interior cavity walls 120 (see FIG. 12C)*. It was an air filled* glass jacket 210 with aluminum wool 132 filling the two side cavities 126. When operated in a horizontal orientation, the temperature difference between front glass (LED emission area) and back glass was only 1 degree C. The highest temperature on the glass surface was only 71 C at ambient 24 C.

*Note: the integrated "on board" driver 140, and features enabling air as fill gas, are described hereinbelow.

Unsealed (Air Filled) Outer Jacket with Breathable Plug to Vent Outgassed Volatile Materials, and Humidity Adsorber As disclosed above and in previous provisional applications, the LED lamp embodiments of this disclosure generally comprise an LED module 100 contained in a bulb/envelope/jacket 210. The module is an LED carrier structure 102 upon which is mounted one or more arrays of LEDs 110 along with interconnecting electrical circuitry/traces 138. The carrier 102 is a metal printed circuit board (MCPCB) 104 designed to conduct heat away from the LED junctions, thereby functioning as the first part of a heat sink. The OJ (jacket) 210 (e.g., glass jacket) is used to protect the LED module components from performance-decreasing damage/deterioration caused by, for example: ambient conditions (e.g., moisture, dirt, chemicals, salt water air), physical contact (e.g., handling, bumping fixture components, collision with moving objects), and the like. The jacket may enable the use of LED's that cannot be used in air, in which case the jacket must be sealed and filled with an inert gas. The jacket 210 may be utilized as a means for dissipating heat generated by the LEDs, for example: using a T bulb tightly fitted around a coaxial LED carrier structure wherein folded MCPCB corners/edges 112 and/or LEDs 110 may touch the jacket's inner wall; using a structure that enhances convective heat transfer from the LEDs to the jacket; and sealing the bulb/jacket with a gas filling at elevated pressure and/or using gases such as helium or hydrogen, all to achieve greater effective thermal conductivity than air or nitrogen.

There are some problems caused by hermetically sealing the LED light source in the outer jacket. For example referring to FIGS. 13A-13B, lamp sealing typically involves heating the bulb/jacket neck 144 enough to neck down and fuse with the flange of a sealing stem that contains electrical lead wires 142 and an exhaust tube 146, then flush-filling through the exhaust tube before melting it closed ("tipping", although FIG. 13B shows an untipped exhaust tube 146). As disclosed, the following problems typically need to be addressed when sealing the LED module inside a glass jacket:

a. sealing heat damaging the module
b. inrush of gas filling via exhaust tube damaging coatings such as phosphors (if present)
c. VOCs outgassing from MCPCB heated by the LEDs accumulate over time to concentrations that damage components and deteriorate LED performance in unacceptably short time frame
d. humidity may be trapped inside (especially with air filling), causing damage such as corrosion
e. gas movement is restricted, limiting convection cooling effectiveness (which can cause LED damage if cooling is inadequate)

These problems have been addressed in the above disclosure, e.g., by using getters, but results may not be optimum, therefor we extended our efforts to lamps without a hermetic seal, i.e., using ambient air as the "gas filling". An advantage of this is reduced cost (no He or H2 and no filling operation). Further cost benefits could accrue by eliminating glass-melting to seal the outer jacket/bulb. An important benefit of an unsealed lamp like this is that it "breathes" so that outgassing VMs may escape rather than accumulate to unacceptable levels, and/or depleting the getter effectiveness.

Although we want to vent outgassed contaminants, we need to prevent ingress of water. Our solution is to provide a water blocking filter. The illustration in FIGS. 13A-B shows an example where the un-tipped exhaust tube 146 is plugged by a polymer based breathable membrane 148, like silicone, esp. methyl type silicone which has excellent gas permeability (e.g., VOCs and water vapor) but blocks passage of water, effectively filtering it out. We use a two-part silicone that doesn't emit VOCs while curing. This membrane 148 allows outgas vapors to exit the lamp to avoid their influences on lamp lumen maintenance.

It may be noted that the silicone membrane 148 has excellent permeability for water vapor, which is a two edged sword. Permeation is driven in part by partial pressure gradient, so VOCs and water vapor will transfer from high to low pressure sides of the membrane. This is good for VOCs which are generally non-existing or at a very low concentration outside a lamp, but this could be a problem if the lamp is operated in a high humidity, high temperature environment. As compensating factors, the relatively small size of the membrane-covered vent hole and the thickness of the membrane will keep permeation at a slow rate to average the effect over time, plus whenever the lamp is operating, any internal water vapor will be at an elevated partial pressure compared to the relatively cooler humid air outside. As a safe guard, a desiccant/humidity adsorber (e.g., getter 162 in FIG. 14A) is included in the lamp 200, such as, for example, active carbon, hygroscopic zeolites, silica (e.g., silica gel), and the like. The silica may be optimum because it is so effective in focusing on water adsorption. It is also very inexpensive. Preferably getter for the VOCs is also included, but not as much is needed for this air-filled lamp compared to what is needed in a hermetically sealed lamp.

The exhaust tube 146 with breathable plug 148 (tube left open ended, not tipped) may be cut short and protectively covered by a lamp base 154 applied to the glass seal area 144. The base 154 would have to be vented (e.g., a breathing hole 152 as shown in FIGS. 14B, 14C, and 15A-C).

Alternatively, the base 154 may be at least partly made from a porous ceramic material 160 having pores too small to allow passage of liquid water. For example, the porous ceramic 160 may be etched polycrystalline alumina.

Plastic Cap Glued on Instead of Heat Sealed Glass (Preferably Clamped in Fixture, not Screw Base) and Vent Hole is Covered by a Sticker/Patch Version of the Silicone Membrane FIGS. 14A-14D illustrate a further improvement of the unsealed jacket concept which eliminates the melted glass neck seal area fused to a stem flange, and the "base" 154 may be simply glued (e.g., silicone adhesive 150) or otherwise adhered onto the open end 212 of a simple tubular jacket/bulb 210 (e.g., glass). This avoids all manufacturing process heating and the potential damaging effects of that, plus it significantly reduces costs. The base 154 could be any shape that allows breathable membrane 148 venting at the open end 212 (straight neck) of the T-bulb 210. For example, a standard metal screw base or DC cylindrical base (neither illustrated), with a suitably dimensioned collar on its open end could be used. Or, for example, a simple cylindrical cap 156, preferably plastic, may be used as shown (also see note below). When used in the present context of an adhesive-like material 150 (e.g., silicone sealant and/or adhesive) that is applied to components of the base 154 and outer jacket 210, the term "seal" (and its variants) means at least preventing passage of water (i.e., a breathable patch/plug/material 148). Otherwise, unless specified as breathable, a "sealing material" may block passage of any or all liquids and gases reasonably expected to be present in the lamp operating environment.

The base 154 may be sealed by adhesive 150 inside the base around the glass jacket 210 end and by sealant 150 applied where the lead wires 142 exit, leaving a breathing hole 152 covered by a patch of breathable membrane 148. Optionally all of the sealant and/or adhesive materials 150 may be breathable. As in the previous example, the breathable material will allow VMs to escape the lamp interior (e.g., through the breathing hole 152) while preventing ingress of water.

Referring to FIGS. 15A-C, advantageously, the plastic cap 154, 156 is made from thermally conductive plastics 158, like graphene blended thermal plastic. For thermally conductive plastic, it has two kinds, one is graphene blended, which is thermally conductive up to 20 W/mK but also electrically conductive. The other kind is BN blended thermal plastic, which has thermal conductivity up to 2 W/mK but electrically insulating. FIGS. 15A-B show bases using the thermally, but not electrically conductive material so the lead wires 142 can touch the base when passing through. The sealant 150 is used for water blocking. However, since glass is super electrically insulative material and lead wires can be sheathed by electrical insulation material like PVC, it is preferable to use graphene type thermally and electrically conductive plastic 158 for the cap 154, 156, thereby benefiting from 10 times as much thermal conductivity. FIG. 15C shows this where the lead wires 142 are in rigid pins that are fixed in the base by an electrically insulating material 164, thereby creating a "2-pin" base/end cap 154.

The benefit of using a thermally conductive plastic 158 cap/base 154, is to build a thermally conductive heat dissipation path from the glass jacket 210 to a base holder (e.g., socket 172, clamp 174, and the like) and then to the external fixture housing 170, which then exchanges thermal energy to ambient air as a fixture heat sink. FIGS. 17 and 18 show how a socket 172 or a bracket/clamp 174 can hold the thermally conductive base 158 in close contact with the metal body of a fixture 170.

Because air at ambient pressure does not have the thermal conductivity/convection advantages of high pressure fillings, particularly He or H2, we optimize the LED module-to-glass jacket heat transfer ability in other ways. We find that adding the metal wool 132 cavity filling to the folded MCPCB 102 with the shape and relative dimensions described above appears to be adequate to prevent LED self-heating thermal damage. Furthermore, damage from heat-sealing is prevented by use of a tubular (T) bulb 210 (preferably straight sided, i.e., no neck) with an end-cap/base 154, 156 adhered over the open tube end 212. Finally, damage due to lamp contaminants (particularly VMs, both VOC and water) is avoided by a combination of venting the lamp through a breathing hole 152 covered by a breathable plug/patch 148 that passes water vapor and VOCs but not water, plus some measures to minimize initial VM content and to getter 162 any ongoing outgassing of whatever VMs may remain. A preferred suitable material for the breathable plug/membrane/waterproofing sealant 148, 150 is methyl type silicone, which has high permeability for gases such as VOCs and water vapor, but blocks water (liquid). As described in the getter section of the present disclosure, measures to minimize initial VM content may include elimination or minimum use of VOC emitting materials on the MCPCB 104. When these measures are combined with the filtered (waterproofed) breathable base 154, 156 the need for getters 162 is greatly reduced versus the fused-glass hermetically sealed lamp. Since condensed water cannot escape through the filter plug 148 a desiccant is still recommended. A small amount of active carbon or zeolite may also be used as a safety margin to control VOC emissions that may build up faster than they can be vented.

Extra getter may be needed if LED driver(s) are added as described below, because they add to the heat load inside the finished lamp. For example, our present on-board driver 140 adds about 10% to the lamp wattage, i.e., approximately 3 W of heat added to an LED module 102 that operates LEDs totaling 27 W of energy consumption (much of which passes out through the bulb as radiant energy/light).

As illustrated in FIG. 16, when an outer jacket 210 is not needed for LED protection (e.g., in a watertight fixture 170) then heat may be directly conducted away from the MCPCB 102 through direct thermal contact with the fixture 170 (e.g., replacing a socket with a clamp 174) instead of indirect transfer through the glass jacket to ambient air. FIGS. 17-18 illustrate using a thermally conductive base 154, 156, 158 on our air filled lamp 200 to implement this principle even when a glass jacket 210 is present, simply by extending the MCPCB 102 to establish close thermal contact with the base 154, 156, 158. The base may be suitable for installation in a fixture socket 172 (e.g., a screw base with a metal or conductive plastic shell), or may be a simpler form that can be clamped in a fixture as shown in FIG. 18.

Referring to FIGS. 15A-C, the MCPCB 102 may extend to the end of the jacket 210 where the base 154, 156 overlaps, thereby establishing an indirect thermal contact area TCA(i) where heat is conducted through a thin intervening layer of jacket glass 210; or even better the MCPCB 102 extends beyond the end of the jacket 210 to directly contact the base 154, 156 in a direct thermal contact area TCA(d). The base would still be made watertight by sealant/adhesive 150 and breathable membrane 148 as described above.

LED Driver(s) "on Board" (on LED Carrier/MCPCB)

The folded MCPCB design has provided extra circuit board space that does not interfere with LED mounting space. By mounting the LED driver circuit 140 on the "top" surface of the MCPCB it can be connected to the LEDs 110 using printed circuit traces 138. As shown in FIGS. 12A-B (also see FIGS. 6A-B and 9A-B), the folding grooves 106 on the bottom side make the MCPCB 104 thin enough to bend/fold with a radius of curvature that doesn't damage the traces 138 that cross the fold (e.g., grooves 106 as shown in FIG. 4).

The driver 140 is preferably positioned on one of the interior cavity walls 120 (e.g., I1 in FIGS. 12A and 12C), where heat from it can be sinked without affecting temperature of LEDs 110 that would otherwise be adjacent.

FIGS. 11 and 12A show an example driver circuit 140. Without using bulky and inefficient inductance or transformer components, it only utilizes a bridge circuit, surface mounted IC chip, MOSFET resistor and capacitor to combine the AC voltage waveform with forward voltage of LEDs to realize DC driving of the LEDs. The circuit uses, for example, a MagnaChip LED driver that is a compact PCB mountable chip (e.g., MAP9000 in diagram). An LED driver and multi HV MOSFETs are integrated into one package. It can drive several LEDs in series from rectified AC line voltage. This provides AC directly converted to DC through an IC chip instead of needing a bulky transformer and inductor.

We implement the driver on board (DoB) 140 for both 120V AC and 277V AC line voltages, and combined with different amounts of LEDs 110. We are first implementing this on MCPCBs 104 sized for a T35, T46, and T55 bulb/jacket 210. The T35 layout is very challenging because of the small area available for the driver circuitry. Prototypes of these three LED modules 100 are shown in FIG. 20. Each has one hundred LEDs 110 laid out on mounting sides 115 and connected to an on-board driver 140 located on an interior wall 120 (e.g., as shown in FIG. 12C). The T55 size is shown as a complete lamp 200 with the module 100 inside a T55 jacket 210 and a base 154 closing the end.

In most of the prior art driver on board (DoB) applications, the DoB components are mounted with LEDs in the same planar area of the flat MCPCB of the LED module. Limited space means must use inductor or transformer. But, in our application, by utilizing the benefits of our bendable MCPCB 104, it allows complicated wiring on a big area of MCPCB 104 and allows locating the DoB components (IC, MOSFET, resistors, capacitor, etc.) in a non-LEDs side (section, e.g., interior wall 120, I1) of the MCPCB 104, thus locating the heating effect of the driver 140 far from the LEDs 110. As shown in the FIG. 12C perspective view, driver cooling is enhanced by its placement in the cavity 124 with chimney effect cooling, however the thermal attachment tab 122 (T1) adjacent to the interior wall 120 (I1) upon which the driver 140 is mounted has been removed as seen in FIGS. 12A-12B, so that it will not be in thermal contact with the front side 118 (e.g., S3) to avoid heating the LEDs 110 on that mounting face.

In a preferred embodiment of the MCPCB with on-board driver we use PI (polyimide) as the dielectric layer to get best MCPCB bending without cracking, and without using a solder mask layer for copper trace to minimize the potential VOCs. In an embodiment, the board thickness is 1.6 mm, with groove is 0.5 mm, and the LED is Everlight KK6C, T1 bin.

No-Jacket Variant

FIG. 16 illustrates use of a simplified VOC dispersing and heat sinked version wherein a non-jacketed LED lamp (i.e., just the LED module 100) may be put in a weathertight fixture 170 that has its own protective lens/cover glass. Heat sinking may be enhanced by attaching a thermally conductive mounting bracket/clamp 174 to the MCPCB 104 that conducts heat away to the fixture frame/structure 170 (e.g., Urban Act floodlight fixture that normally uses 50 W or 75 W CMH lamps, 4-6" long, horizontal burning in a reflector.) The reflector is removed because it is not needed when the LED lamp (e.g., LED module 100) has LEDs 110 on two mounting sides 115 that are angled to yield, for example, an approximately 270 degree beam spread without using a reflector, as shown in FIG. 3. Alternatively, FIG. 19 shows how a fixture reflector 171 may be used to limit the degrees of beam spread to less than the BEAM SPREAD produced by the mounting face angle ANGLE1. FIG. 17 shows a glass jacketed LED lamp 200 that can also use the same fixture without a reflector.

Refinements, More Details and/or Improvements

As shown in FIGS. 16-18, embodiments of our new GJ LED lamp design may be used to replace HID lamps & ballasts by retrofitting in old fixtures/luminaires 170 (e.g., "shoebox"). The term HID (High Intensity Discharge) used herein includes MH (Metal Halide), and CMH (Ceramic Metal Halide).

FIGS. 16-17 show an Urban Act™ floodlight housing retrofitted with ~20 W, 3000 lumen LED lamp (replaces a 50 W, 3000 lumen ceramic metal halide lamp with a screw base typically used in this fixture). The HID ballast is removed. Two options: a) Replace ballast with an LED driver in fixture, or b) Use the on board driver 140, and wire the AC line voltage supply directly to the LED module 100, which is our preferred lamp embodiment.

In the FIG. 17 embodiment, the LED lamp 200 has a plastic base/cap 156 and an air filled T bulb 210. The base may be made of a thermally conductive material 158. The base could include a screw base shell so that the lamp could be installed using the existing socket. Alternatively, other types of bases could be used and the socket would be modified as needed.

In the FIG. 18 embodiment, the fixture 170 has a clamping socket 174 that holds the thermally conductive base 154, 156, 158 in close contact with the reflector 171 and/or the metal body of the fixture 170, thus providing an external heat sink for the lamp jacket 210 through the base.

FIG. 18 shows a floodlight housing 170 modified to retrofit an approximately 60 W 10,000 lumen T55 glass jacketed LED test lamp 200. This replaces a metal halide HID lamp with a screw base typically used in this fixture (shown lying in the reflector 171 for illustrative comparison). In this embodiment, the LED lamp 200 has a thermally conductive plastic base/cap 156, 158, and an air filled T55 (55 mm diameter) glass bulb/outer jacket 210. The fixture 170 (hinged lid with cover glass not shown) is modified to remove the mogul socket and replace it with a heat sinking screw clamp 174 (that also enables aiming the LED mounting faces 115 of the LED module in the lamp 200). The reflector 171 is somewhat redundant because the two LED mounting faces 115 are angled to direct most of the light outward. However, as seen in FIG. 19, the reflector 171 may do some beam shaping and establish cutoff limits (on uplight for example).

Figure 14D:
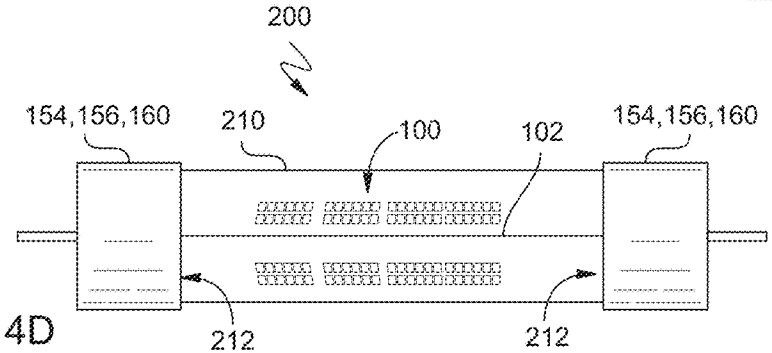

FIG. 14D illustrates an embodiment having a single pin base/cap 154 (optionally plastic 156) on both ends, so that a plain cylindrical tube can be used for a jacket 210 without needing a domed end, thus providing a cost savings. Suitable for retrofitting in a fixture for a double ended T bulb. As illustrated in FIG. 14B, the base caps 154, 156 (optionally thermally conductive 158) are glued 150 over open ends 212 of the jacket 210 and a vent hole 152 is covered with a breathable membrane 148 (e.g., a silicone patch).

LEDs 110 can be applied to any or all outside surfaces of the folded MCPCB to achieve directional or non-directional lighting, as described above.

At present, the following are approximate specs, partly based on testing to date, for embodiments of three potential versions of the glass jacketed LED lamp 200. (The listed power numbers include power consumed by an on-board LED driver 140, which adds roughly 10% to the total LED power consumption):

T35 bulb: 20 W, 3,000 lm

T46 bulb: 30-38 W, 5,000 lm

T55 bulb: 50 W, 6,000 lm; 52 W, 6500 lm; and 60 W, 10,000 lm

FIG. 20 shows a prototype T55 lamp 200 compared to prototype T35 and T46 lamp LED modules 100.

Example Test Results:

A 27 W T46 DoB integrated (which adds 3 W), air filled glass jacket lamp 200 with Al wool 132 was tested under direct AC line voltage with a mogul base, on horizontal burning direction.

The temperature difference between front glass (LED emission area) and back glass is only 1 C.

The basic reason for so small temperature difference is really from the filled Al wool 132 in the interior cavity(s) of the bended MCPCB 104 to successfully minimize the thermal resistance between front and back surfaces of the glass jacket 210.

The highest temperature on the glass surface is only 71 C at ambient 24 C.

Although the invention has been illustrated and described in detail in the drawings and foregoing description, the same is to be considered as illustrative and not restrictive in character—it being understood that the embodiments shown and described have been selected as representative examples including presently preferred embodiments plus others indicative of the nature of changes and modifications that come within the spirit of the invention(s) being disclosed and within the scope of invention(s) as claimed in this and any other applications that incorporate relevant portions of the present disclosure for support of those claims. Undoubtedly, other "variations" based on the teachings set forth herein will occur to one having ordinary skill in the art to which the present invention most nearly pertains, and such variations are intended to be within the scope of the present disclosure and of any claims to invention supported by said disclosure.

What is claimed is:

1. A glass jacketed LED lamp comprising:

a prismatic LED module positioned coaxial to a center axis of a cylindrical glass jacket having an inside diameter D1, wherein the LED module comprises:

a prismatic LED carrier structure having a quantity N of longitudinal sides, and LEDs that are operationally mounted on at least one of the N sides; wherein:

the carrier structure was formed by folding a single metal core printed circuit board (MCPCB) into a convex prismatic polyhedron having a cross section that is an irregular and incomplete polygon such that the N sides are bounded by a quantity equal to N+1 of longitudinal fold edges;

a first edge and the (N+1)th edge are back edges that are spaced apart by a first separation GAP1;

one or two of the N longitudinal sides being distal to the back edges are front side(s), and the MCPCB board extends from at least one of the back edges inward toward the front side(s), thereby forming at least one interior wall that divides the structure into an open cavity flanked by at least one side cavity; and at least the second through the Nth edges are in thermal contact with the glass jacket.

2. The lamp of claim 1 wherein:

the back edges are spaced inward from the jacket inside diameter D1 by a second separation GAP2.

3. The lamp of claim 1 wherein:

the at least one interior wall is thermally attached to the front side(s), thereby additionally heat sinking the front side(s).

4. The lamp of claim 3 further comprising:

LEDs mounted only on the front side(s);

thereby providing directed light output with a beam spread substantially determined by the angles at the edges of the one or two front sides.

5. The lamp of claim 1 wherein:

in an unbiased neutral state, the LED carrier edges are circumscribed by a circle of diameter D2' that is greater than the jacket inside diameter D1, and the MCPCB is resilient with a spring bias toward the neutral state, such that the module is in a constricted state when inside the jacket, thereby biasing the fold edges into thermal contact with the jacket wall, and providing friction to hold the LED module in a predetermined longitudinal position within the jacket.

6. The lamp of claim 1 further comprising:

a wool-like porous and highly interconnected lightweight material having thermal conductivity greater than about 10 W/mK, substantially filling one or more of the center and the side cavities, and thermally contacting the interior walls and the sides therearound.

7. The lamp of claim 1 wherein:

the MCPCB comprises a polyimide dielectric layer, and copper traces without a solder mask layer;

thereby enabling MCPCB bending without surface cracking, and minimizing potential volatile organic compound emissions.

8. The lamp of claim 7 further comprising:

an AC LED driver circuit mounted on at least one carrier side that is separate from any side that is an LED mounting face.

9. The lamp of claim 7 further comprising:

an AC LED driver circuit mounted on at least one of the at least one interior walls.

10. The lamp of claim 1 further comprising:

a lamp base adhered over an open end of the jacket.

11. The lamp of claim 10 wherein:

the base is plastic.

12. The lamp of claim 10 wherein:

the base has thermal conductivity greater than 1 W/mK.

13. The lamp of claim 12 wherein:

the LED carrier extends into thermal contact with the base.

14. The lamp of claim 10 wherein:

the base comprises a watertight seal for the lamp wherein vent openings are sealed or covered by a methyl silicone breathable membrane or adhesive or sealant, thereby allowing egress of volatile materials while blocking liquid water.

15. The lamp of claim 10 further comprising:

a desiccant material inside the jacket.

16. The lamp of claim 10 further comprising:

one or a combination of getters inside the jacket for capturing volatile materials, wherein the getters are selected from a group that includes: active carbon, natural zeolite, de-aluminized zeolite, surface treated zeolite, and silica.

17. The lamp of claim 10 wherein:

the base is at least partly made from a porous ceramic having pores too small to allow passage of liquid water.

18. The lamp of claim 17 wherein:

the porous ceramic is etched polycrystalline alumina.

* * * * *